US009280939B2

(12) United States Patent
Muto et al.

(10) Patent No.: US 9,280,939 B2
(45) Date of Patent: Mar. 8, 2016

(54) METHOD OF CONTROLLING ELECTROPHORETIC DISPLAY DEVICE, CONTROL DEVICE FOR ELECTROPHORETIC DEVICE, ELECTROPHORETIC DEVICE, AND ELECTRONIC APPARATUS

(75) Inventors: Kota Muto, Suwa (JP); Yusuke Yamada, Matsumoto (JP); Toshimichi Yamada, Suwa (JP); Hiroaki Kanamori, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 225 days.

(21) Appl. No.: 13/443,364

(22) Filed: Apr. 10, 2012

(65) Prior Publication Data

US 2012/0262505 A1 Oct. 18, 2012

Related U.S. Application Data

(60) Provisional application No. 61/484,410, filed on May 10, 2011.

(30) Foreign Application Priority Data

Apr. 15, 2011 (JP) ..... 2011-090914
Aug. 24, 2011 (JP) ..... 2011-182706

(51) Int. Cl.
*G09G 3/34* (2006.01)

(52) U.S. Cl.
CPC ..... *G09G 3/344* (2013.01); *G09G 2310/02* (2013.01); *G09G 2310/06* (2013.01)

(58) Field of Classification Search
CPC ..... G09G 3/344
USPC ..... 345/107
See application file for complete search history.

(56) References Cited

U.S. PATENT DOCUMENTS

| | | | | |
|---|---|---|---|---|
| 2002/0021483 | A1 | 2/2002 | Katase | |
| 2003/0063076 | A1 * | 4/2003 | Machida et al. | 345/204 |
| 2006/0170667 | A1 * | 8/2006 | Zhou et al. | 345/208 |
| 2006/0187189 | A1 * | 8/2006 | Komatsu | 345/107 |
| 2006/0192751 | A1 * | 8/2006 | Miyasaka et al. | 345/107 |
| 2006/0262080 | A1 * | 11/2006 | Matsuda | 345/107 |
| 2007/0080927 | A1 * | 4/2007 | Zhou et al. | 345/107 |

(Continued)

FOREIGN PATENT DOCUMENTS

| | | |
|---|---|---|
| JP | B2-3750565 | 3/2006 |
| JP | A-2010-113281 | 5/2010 |

(Continued)

*Primary Examiner* — Adam J Snyder
(74) *Attorney, Agent, or Firm* — Oliff PLC

(57) ABSTRACT

A method of controlling an electro-optical device includes, during image rewriting, executing a first control operation to supply a potential different from a potential on a counter electrode to a pixel electrode of a first pixel in a plurality of frame periods, executing a second control operation to supply the same potential as the potential on the counter electrode to a pixel electrode of a second pixel, which is adjacent to the first pixel and in which a gradation to be displayed during image rewriting is not changed, in at least some frame periods of a plurality of frame periods, and executing a third control operation to supply a potential different from the potential on the counter electrode to the pixel electrode of the second pixel in a frame period after the potential has been supplied in at least one frame period during the first control operation.

6 Claims, 12 Drawing Sheets

(56) References Cited

U.S. PATENT DOCUMENTS

| | | | | |
|---|---|---|---|---|
| 2007/0212022 | A1* | 9/2007 | Zhou et al. | 386/107 |
| 2009/0096722 | A1* | 4/2009 | Moriya et al. | 345/76 |
| 2009/0237351 | A1* | 9/2009 | Kanamori et al. | 345/107 |
| 2009/0244105 | A1* | 10/2009 | Lee et al. | 345/690 |
| 2009/0303228 | A1* | 12/2009 | Maeda et al. | 345/107 |
| 2009/0322220 | A1* | 12/2009 | Komatsu | 313/505 |
| 2010/0118046 | A1 | 5/2010 | Miyasaka et al. | |
| 2011/0216055 | A1* | 9/2011 | Chiu et al. | 345/107 |
| 2011/0221732 | A1 | 9/2011 | Muto et al. | |
| 2011/0242147 | A1 | 10/2011 | Muto et al. | |

FOREIGN PATENT DOCUMENTS

| | | |
|---|---|---|
| JP | A-2011-191375 | 9/2011 |
| JP | A-2011-232718 | 11/2011 |

* cited by examiner

METHOD OF CONTROLLING ELECTROPHORETIC DISPLAY DEVICE, CONTROL DEVICE FOR ELECTROPHORETIC DEVICE, ELECTROPHORETIC DEVICE, AND ELECTRONIC APPARATUS

BACKGROUND

1. Technical Field

The present invention relates to technical fields of a method of controlling an electro-optical device, such as an electrophoretic display device, a control device for an electro-optical device, an electro-optical device, and an electronic apparatus.

2. Related Art

As an example of this type of electro-optical device, an electrophoretic display is known in which a voltage is applied between a pixel electrode and a counter electrode arranged to be opposite each other with an electrophoretic element including electrophoretic particles interposed therebetween, and the electrophoretic particles, such as black particles and white particles, are moved to display an image in a display section (for example, see Japanese Patent No. 3750565 and JP-A-2010-113281). The electrophoretic element has a plurality of microcapsules each including a plurality of electrophoretic particles, and is fixed between the pixel electrode and the counter electrode by an adhesive made of resin or the like. The counter electrode may be called a common electrode.

In this electrophoretic display, a driving method to partially rewrite an image (hereinafter, referred to as "partial rewrite driving") is used in which, when an image displayed in the display section is rewritten, if an image is merely partially changed, a voltage is applied between the pixel electrode and the counter electrode only in each pixel corresponding to a changing portion. In an electrophoretic display which uses partial rewrite driving, for example, it is known that a boundary between a black image portion displayed with black and a white image portion with white in an image displayed in the display section may be blurred. In other words, an edge portion of the black image portion spreads (or is inflated) toward the white image portion (for example, see JP-A-2010-113281). If blurring of the boundary occurs, a voltage is applied only to pixels corresponding to the black image portion. In this case, when an image displayed in the display section is rewritten to a full white image, blurring of the boundary remains as a residual image. In other words, a residual image is generated along the edge portion of the black image portion having been displayed. In the following description, a phenomenon in which a residual image remains along the edge portion, or a residual image along the edge portion occurs is called "edge residual image". For example, JP-A-2010-113281 describes a technique in which, when an image displayed in the display section is rewritten to a full white image by partial rewrite driving (that is, the black image portion is erased), in addition to pixels corresponding to the black image portion, a voltage is also applied to pixels which are arranged adjacent to pixels corresponding to the edge portion of the black image portion and in which white is displayed, thereby erasing an edge residual image.

However, according to the technique described in JP-A-2010-113281, while the edge residual image can be erased, there is a technical problem in that it is difficult to suppress the occurrence of blurring of the boundary.

SUMMARY

An advantage of some aspects of the invention is that it provides a method of controlling an electro-optical device, a control device for an electro-optical device, an electro-optical device, and an electronic apparatus capable of suppressing the occurrence of blurring of a boundary of an image displayed in a display section and displaying a high-quality image.

An aspect of the invention provides a method of controlling an electro-optical device. The electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section. The method includes, during image rewriting to rewrite an image displayed in the display section, executing a first control operation to supply a potential different from a potential on the counter electrode to the pixel electrode of a first pixel, in which a gradation to be displayed is changed, in a plurality of frame periods, executing a second control operation to supplying the same potential as the potential on the counter electrode to the pixel electrode of a second pixel, which is adjacent to the first pixel and in which a gradation to be displayed during image rewriting is not changed, in at least some frame periods of the plurality of frame periods, and executing a third control operation to supplying a potential different from the potential on the counter electrode to the pixel electrode of the second pixel in a frame period after the potential has been supplied in at least one frame period during the first control operation.

The electro-optical device which is controlled by the method of controlling an electro-optical device according to the aspect of the invention is, for example, an active matrix driving electrophoretic display or the like. The electro-optical device includes a display section which has a plurality of pixels arranged, for example, in a matrix at intersections of a plurality of scanning lines and a plurality of data lines, and a driving section which supplies a data potential based on image data to the pixel electrode of each pixel. In the electro-optical device, the driving section executes potential supply (in other words, a rewrite operation to rewrite the data potential based on image data to the pixel electrode of each of a plurality of pixels in a predetermined frame period) multiple times to supply the data potential based on image data to the pixel electrode of each of a plurality of pixels in a predetermined frame period (specifically, in a predetermined frame period, a plurality of scanning lines are selected once in a predetermined order, and the data potential is supplied to the pixels corresponding to the selected scanning line through a plurality of data lines). That is, an image based on image data is displayed in the display section. That is, the data potential is rewritten multiple times to the pixel electrode of each of a plurality of pixels in every predetermined frame period, such that an image based on image data is displayed in the display section. The term "frame period" used herein means a period which is determined in advance as a period in which a plurality of scanning lines are selected once in a predetermined order. That is, potential supply to supply the data potential to the pixel electrode of each of a plurality of pixels in each of a plurality of continuous frame periods is executed once by the driving section, such that an image based on image data is displayed in the display section.

With the method of controlling an electro-optical device according to the aspect of the invention, during image rewriting to rewrite an image (for example, a two-gradation image having two gradations of white and black) displayed in the display section, as the multiple times of potential supply, the first control operation, the second control operation, and the third control operation are executed. The first control operation, the second control operation, and the third control operation may be executed sequentially or may be executed in parallel.

During the first control operation, a potential (for example, a high potential higher than the potential on the counter electrode or a low potential lower than the potential on the counter electrode) which is different from the potential on the counter electrode is supplied to the pixel electrode of a first pixel, in which a gradation to be displayed is changed (for example, is changed from white to black or from black to white), in a plurality of frame periods. Accordingly, during the first control operation, the gradation of the first pixel is changed to the gradation to be displayed in a stepwise manner over a plurality of frame periods.

During the second control operation, the same potential (for example, 0 volt) as the potential on the counter electrode is supplied to the pixel electrode of a second pixel, which is adjacent to the first pixel and in which the gradation to be displayed during image rewriting is not changed (for example, is maintained white or black), in at least some frame periods of a plurality of frame periods in which the first control operation is executed. The term "at least some frame periods" used herein means frame periods other than the frame periods, in which potential supply is executed by the third control operation described below, from among a plurality of frame periods in which an image is rewritten. During the second control operation, since the same potential as the potential on the counter electrode is supplied to the pixel electrode of the second pixel where a gradation is not changed, no voltage is applied between the pixel electrode and the counter electrode, and an image is not changed. The term "the same potential as the potential on the counter electrode" used herein is not intended to strictly indicate only the same potential, and includes a slightly different potential. For example, even when the potential on the counter electrode has a value different from the potential supplied to the pixel electrode of the second pixel taking into consideration variations in the potential on the pixel electrode due to feedthrough, the potential supplied to the pixel electrode of the second pixel is regarded as the same as the potential on the counter electrode.

With the first control operation and the second control operation, during image rewriting, a voltage is applied between the pixel electrode and the counter electrode in the first pixel where a gradation is changed, and no voltage is applied between the pixel electrode and the counter electrode in the second pixel where a gradation is not changed. Accordingly, during image rewriting, the entire image is not rewritten, and a region where an image is changed is partially rewritten.

According to the aspect of the invention, in particular, a potential different from the potential on the counter electrode is supplied to the pixel electrode of the second pixel by the third control operation in a frame period (that is, a frame period after the gradation of the first pixel has been significantly changed due to the image rewriting) after the potential has been supplied in at least one frame period by the first control operation. The term "the potential different from the potential on the counter electrode" supplied to the second pixel by the third control operation may be the same as or different from "the potential different from the potential on the counter electrode" supplied to the first pixel during the first control operation.

With the third control operation, it is possible to reduce image blurring which occurs during the first control operation and the second control operation. For example, of the first and second pixels which display white, when only the first pixel is rewritten to black, a voltage for displaying black is applied to the first pixel, and no voltage is applied to the second pixel. At this time, a voltage applied to the first pixel leaks to the second pixel, grey blurring partially occurs on the first pixel side of the second pixel. Meanwhile, during the third control operation, a voltage for displaying white is applied to the second pixel. Therefore, it is possible to reduce blurring which occurs in the second pixel.

Alternatively, in a state where the first pixel displays black and the second pixel displays white, only the first pixel is rewritten to white, a voltage for displaying white is applied to the first pixel, and no voltage is applied to the second pixel. At this time, if blurring already occurs in the second pixel where the gradation is not changed (that is, if blurring has occurred when the first pixel is rewritten to black in a previous frame period), blurring remains in the second pixel even after the first pixel has been rewritten to white, and appears as an edge residual image surrounding the first pixel. Meanwhile, during the third control operation, a voltage for displaying white is applied to the second pixel. Therefore, it is possible to reduce an edge residual image which occurs in the second pixel.

As described above, with the method of controlling an electro-optical device according to the aspect of the invention, it is possible to reduce new blurring which occurs due to image rewriting, and to reduce an edge residual image due to image rewriting in a state where blurring already occurs. As a result, it becomes possible to display a high-quality image.

In one aspect of the method according to the invention, the third control operation is executed in frame periods of the second half of the plurality of frame periods.

With this configuration, the third control operation is executed in at least one frame period of the second half of a plurality of frame periods for rewriting an image (that is, a frame period after the first control operation and the second control operation have at least half ended). Therefore, it is possible to more reliably reduce blurring which occurs when an image is rewritten.

In one aspect of the method according to the invention, the third control operation is executed in the last frame period of the plurality of frame periods.

With this configuration, the third control operation is executed in a period including the last frame period from among a plurality of frame periods for rewriting an image. Therefore, it is possible to more reliably reduce blurring which occurs when an image is rewritten.

In one aspect of the method according to the invention, the third control operation is executed in a frame period immediately after the plurality of frame periods.

With this configuration, the third control operation is executed in a frame period immediately after a plurality of frame periods for rewriting an image (that is, immediately after the first control operation and the second control operation have ended). Therefore, it is possible to more reliably reduce blurring which occurs when an image is rewritten.

When the third control operation is performed in a frame period immediately after the plurality of frame periods, the method may further include a fourth control operation to supply the same potential as the potential on the counter electrode to the pixel electrode of the first pixel in a frame period immediately after the plurality of frame periods.

In this case, no voltage is applied to the first pixel, in which image rewriting has ended in a plurality of frame periods, in a frame period immediately after a plurality of frame periods.

Therefore, it is possible to suppress or prevent collapse of a DC balance ratio (that is, the ratio of the time for which a voltage based on one gradation is applied between the pixel electrode and the counter electrode and the time for which a voltage based on another gradation is applied between the pixel electrode and the counter electrode) in the first pixel. As a result, it is possible to reduce display burning or deterioration of the display section.

In one aspect of the method according to the invention, the third control operation is executed only in one frame period.

With this configuration, the third control operation is executed only in one frame period, thereby minimizing the period in which a voltage is applied to the second pixel. Therefore, it is possible to suppress or prevent collapse of the DC balance ratio in the second pixel.

In one aspect of the method according to the invention, the method further includes executing a fifth control operation to supply a potential corresponding to a gradation, which is different from the potential supplied during the third control operation, to the pixel electrode of the second pixel more as much as the frame period, in which the potential is supplied during the third control operation, in a frame period after the plurality of frame periods.

With this configuration, the fourth control operation is executed in a frame period after a plurality of frame periods (that is, after image rewriting has ended). During the fifth control operation, a potential corresponding to a gradation different from the potential supplied during the third control operation is supplied to the pixel electrode of the second pixel more as much as the frame period in which the potential is supplied by the third control operation. For example, when a potential for displaying white is supplied in two frame periods during the third control operation, during the fifth control operation, a potential for displaying black is supplied more than a period necessary for normal rewriting by two frame periods. Therefore, it is possible to suppress or prevent collapse of the DC balance ratio in the second pixel.

In one aspect of the method according to the invention, during the third control operation, the number of executions per predetermined period is limited to be equal to or smaller than a predetermined number of times.

With this configuration, the number of executions of the third control operation per predetermined period is limited to be equal to or smaller than a predetermined number of times. Accordingly, the third control operation is continuously executed, thereby suppressing or preventing collapse of the DC balance ratio in the second pixel. The "predetermined period" is set as a period which becomes the reference for limiting the number of executions of the third control operation. For example, the predetermined period is set in advance on the basis of the influence on the DC balance ratio because the third control operation is continuously executed in a given period. The "predetermined number of times" is set as the number of executions of the third control operation which is permitted in a predetermined period. For example, the predetermined number of times is set in advance as the number of times in which there is little or no influence on the DC balance ratio because the third control operation is continuously executed.

In one aspect of the method according to the invention, during the third control operation, the number of frame periods in which the absolute value of a voltage or a potential applied between the pixel electrode and the counter electrode of the second pixel differs depending on a gradation to be displayed by the second pixel.

With this configuration, the absolute value of a voltage applied between the pixel electrode and the counter electrode of the second pixel or the number of frame periods in which a potential is applied to the pixel electrode of the second pixel differs depending on the gradation to be displayed in the second pixel. That is, the blurring reduction effect of the third control operation is set to differ depending on the gradation to be displayed in the second pixel.

For example, in the electrophoretic display which uses the electrophoretic element, the white response speed and the black response speed are different from each other, such that the degree of blurring in a pixel which displays white is different from the degree of blurring in a pixel which displays black. Therefore, the blurring reduction effect by the third control operation is changed depending on the gradation to be displayed in the second pixel, thereby more appropriately reducing blurring.

In one aspect of the method according to the invention, the absolute value of the difference between the potential supplied to the pixel electrode of the second pixel during the third control operation and the potential on the counter electrode is smaller than the absolute value of the difference between the potential supplied to the pixel electrode of the first pixel during the first control operation and the potential on the counter electrode.

With this configuration, the absolute value (that is, a voltage which is applied to reduce blurring) of the difference between the potential supplied to the pixel electrode of the second pixel during the third control operation and the potential on the counter electrode is smaller than the absolute value (that is, a voltage which is applied during normal rewriting) of the difference between the potential supplied to the pixel electrode of the first pixel during the first control operation and the potential on the counter electrode. For example, the voltage applied to the second pixel during the third control operation is −5 V, and the voltage applied to the first pixel during the first control operation is +15 V.

With the above-described control, it is possible to make the voltage applied to the second pixel comparatively small during the third control operation, thereby effectively suppressing collapse of the DC balance ratio.

Another aspect of the invention provides a method of controlling an electro-optical device. The electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section. The method includes during image rewriting to rewrite an image displayed in the display section, executing a control operation A to control the driving section such that, in the frame periods, a second gradation potential based on a second gradation is supplied as the data potential to the pixel electrode of each pixel corresponding to a first region which is a region where a gradation to be displayed in the display section is changed from a first gradation to the second gradation different from the first gradation, a first gradation potential based on the first gradation is supplied as the data potential to the pixel electrode of each pixel corresponding to a second region of the display section which is a region where the gradation to be displayed in the display section is changed from the second gradation to the first gradation, and the same potential as the potential on the counter electrode is supplied to the pixel electrode of each pixel corresponding to each of a third region which is a region where the gradation to be displayed in the display section is not changed from the first gradation and a fourth region which is a region where the gradation to be displayed in the display section is not changed from the second gradation, and during image rewriting, executing a control operation B to control the driving section such that, in the frame periods, the first gradation potential is supplied as the data potential to the pixel electrode of each pixel corresponding to a fifth region, which is a region adjacent to the first region to surround at least a part of the first region at a predetermined width in the third region of the display section.

With this method, during the control operation A, the driving section is controlled such that, in the frame periods, the second gradation potential (for example, a high potential higher than the potential on the counter electrode, specifically, +15 volt) based on the second gradation is supplied as the data potential to the pixel electrode of each pixel corresponding to the first region where the gradation to be displayed is changed from the first gradation (for example, white) to the second gradation (for example, black), the first gradation potential (for example, a low potential lower than the potential on the counter electrode, specifically, −15 volt) based on the first gradation is supplied as the data potential to the pixel electrode of each pixel corresponding to the second region where the gradation to be displayed is changed from the second gradation (for example, black) to the first gradation (for example, white), and the same potential (for example, 0 volt) as the potential on the counter electrode is supplied to the pixel electrode of each pixel corresponding to each of the third and fourth regions where the gradation to be displayed is not changed. Accordingly, during the control operation A, when an image is merely partially changed at the time of image rewriting, a voltage is applied between the pixel electrode and the counter electrode only in each pixel corresponding to a changing portion (that is, the first and second regions), and the image is partially rewritten. At this time, since the same potential as the potential on the counter electrode is supplied to the pixel electrode of each pixel corresponding to an unchanging portion (that is, the third and fourth regions), no voltage is applied between the pixel electrode and the counter electrode, and the image is not changed.

During the control operation B, the driving section is controlled such that, in the frame periods, the first gradation potential (for example, a low potential lower than the potential on the counter electrode, specifically, −15 volt) is supplied as the data potential to the pixel electrode of each pixel corresponding to the fifth region which is the region adjacent to the first region where the gradation to be displayed is changed from the first gradation (for example, white) to the second gradation (for example, black) to surround at least a part of the first region at a predetermined width (for example, a width corresponding to the size of one pixel) in the third region where the gradation to be displayed is not changed from the first gradation (for example, white). Accordingly, during the control operation 13, at the time of image rewriting, a voltage based on the potential difference between the first gradation potential (for example, −15 volt) and the potential on the counter electrode (for example, 0 volt) is applied between the pixel electrode and the counter electrode of each pixel corresponding to the fifth region. The term "predetermined width" used herein is, for example, the width corresponding to the size of one pixel, the width corresponding to the size of two pixels, or the like. The predetermined width is set as the length from the edge of the first region to a pixel, which is not electrically adversely affected by the pixels corresponding to the first region, from among the pixels corresponding to the third region.

Accordingly, it is possible to apply a voltage based on the first gradation between the pixel electrode and the counter electrode in each pixel corresponding to the fifth region which is the region adjacent to the first region where the gradation to be displayed is changed from the first gradation (for example, white) to the second gradation (for example, black) to surround at least a part of the first region in the third region where the gradation to be displayed is not changed from the first gradation (for example, white), and to reliably display the first gradation (for example, white) in each pixel corresponding to the fifth region. Therefore, it is possible to suppress blurring of the boundary between a first gradation image (for example, white image) displayed in the first gradation and a second gradation image (for example, black image) displayed in the second gradation in the image displayed in the display section, thereby suppressing the occurrence of an edge residual image.

As described above, with the method of controlling an electro-optical device according to the aspect of the invention, it is possible to suppress the occurrence of blurring of the boundary of the image displayed in the display section, thereby suppressing the occurrence of an edge residual image. As a result, it becomes possible to display a high-quality image.

In one aspect of the method according to the invention, the control operation B is executed as at least single potential supply of the second-half potential supply of the multiple times of potential supply.

With this configuration, the control operation B is executed as at least single potential supply of the second-half potential supply of the multiple times of potential supply (usually, the last potential supply, and when the last potential supply corresponds to "discharge" in which the reference potential GND is written to all pixels to remove residual charges, the second last potential supply). Therefore, it is possible to more reliably suppress the occurrence of blurring of the boundary of the image displayed in the display section.

In one aspect of the method according to the invention, during the control operation B, the driving section is controlled such that the second gradation potential is supplied to the pixel electrode of each pixel corresponding to the first region as the data potential, and the first gradation potential is supplied to the pixel electrode of each pixel corresponding to the second region as the data potential.

With this configuration, it is possible to apply a voltage based on the first gradation or the second gradation for a long time between the pixel electrode and the counter electrode in a pixel (in other words, a pixel where the gradation should be changed) where the gradation to be displayed is changed at the time of image rewriting, and to more reliably change the gradation of a pixel where the gradation should be changed. Accordingly, it is possible to display a clear image in the display section. In regard to each pixel, it is possible to suppress or prevent collapse of the DC balance ratio (that is, the ratio of the time for which a voltage based on the first gradation is applied between the pixel electrode and the counter electrode and the time for which a voltage based on the second gradation is applied between the pixel electrode and the counter electrode). That is, in regard to each pixel, it is possible to reduce the difference between the time for which a voltage based on the first gradation is applied between the pixel electrode and the counter electrode and the time for which a voltage based on the second gradation is applied.

Still another aspect of the invention provides a control device for an electro-optical device. The electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section. The control device includes a first control unit which, during image rewriting to rewrite an image displayed in the display section, supplies a potential different from a potential on the counter electrode to the pixel electrode of a first pixel, in which a gradation to be displayed is changed, in a plurality of frame periods, a second control unit which supplies the same potential as the potential on the counter electrode to the pixel electrode of a second pixel, which is adjacent to the first pixel and in which a gradation to be displayed during image rewriting is not changed, in at least some frame periods of the plurality of frame periods, and a third control unit which supplies a potential different from the potential on the counter electrode to the pixel electrode of the second pixel in a frame period after the potential has been supplied in at least one frame period by the first control unit.

Yet another aspect of the invention provides a control device for an electro-optical device. The electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section. The control device includes a first control unit which, during image rewriting to rewrite an image displayed in the display section, controls the driving section such that, in the frame periods, a second gradation potential based on a second gradation is supplied as the data potential to the pixel electrode of each pixel corresponding to a first region which is a region where a gradation to be displayed in the display section is changed from a first gradation to the second gradation different from the first gradation, a first gradation potential based on the first gradation is supplied as the data potential to the pixel electrode of each pixel corresponding to a second region of the display section which is a region where the gradation to be displayed in the display section is changed from the second gradation to the first gradation, and the same potential as the potential on the counter electrode is supplied to the pixel electrode of each pixel corresponding to each of a third region which is a region where the gradation to be displayed in the display section is not changed from the first gradation and a fourth region which is a region where the gradation to be displayed in the display section is not changed from the second gradation, and a second control unit which, during image rewriting, controls the driving section such that, in the frame periods, the first gradation potential is supplied as the data potential to the pixel electrode of each pixel corresponding to a fifth region which is a region adjacent to the first region to surround at least a part of the first region at a predetermined width in the third region of the display section.

With the control device for an electro-optical device according to the aspect of the invention, similarly to the method of controlling an electro-optical device according to the foregoing aspects of the invention, in the electro-optical device, it is possible to reduce new blurring which occurs due to image rewriting and to reduce an edge residual image which occurs due to image rewriting in a state where blurring already occurs. As a result, it becomes possible to display a high-quality image.

In the control device for an electro-optical device according to the aspect of the invention, various modes which are similar to various aspects in the above-described method of controlling an electro-optical device can be used.

Still yet another aspect of the invention provides an electro-optical device including the above-described control device for an electro-optical device (including various aspects).

With the electro-optical device according to the aspect of the invention, the above-described control device for an electro-optical device is provided. Therefore, it is possible to reduce new blurring which occurs due to image rewriting, and to reduce an edge residual image due to image rewriting in a state where blurring already occurs. As a result, it becomes possible to display a high-quality image.

Further another aspect of the invention provides an electronic apparatus including the above-described electro-optical device (including various aspects).

With the electronic apparatus according to the aspect of the invention, the above-described electro-optical device is provided. Therefore, it is possible to realize various electronic apparatuses, such as a wristwatch, an electronic paper, an electronic notebook, a mobile phone, and a portable audio instrument, which can display a high-quality image.

The above and other features and advantages of the invention will become apparent from embodiments described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In the following embodiments, an electrophoretic display which is an example of an electro-optical device according to the invention will be described.

First Embodiment

First, an electrophoretic display of a first embodiment will be described with reference to FIGS. 1 to 13.

Apparatus Configuration

The overall configuration of the electrophoretic display of this embodiment will be described with reference to FIGS. 1 to 2.

Figure 1:
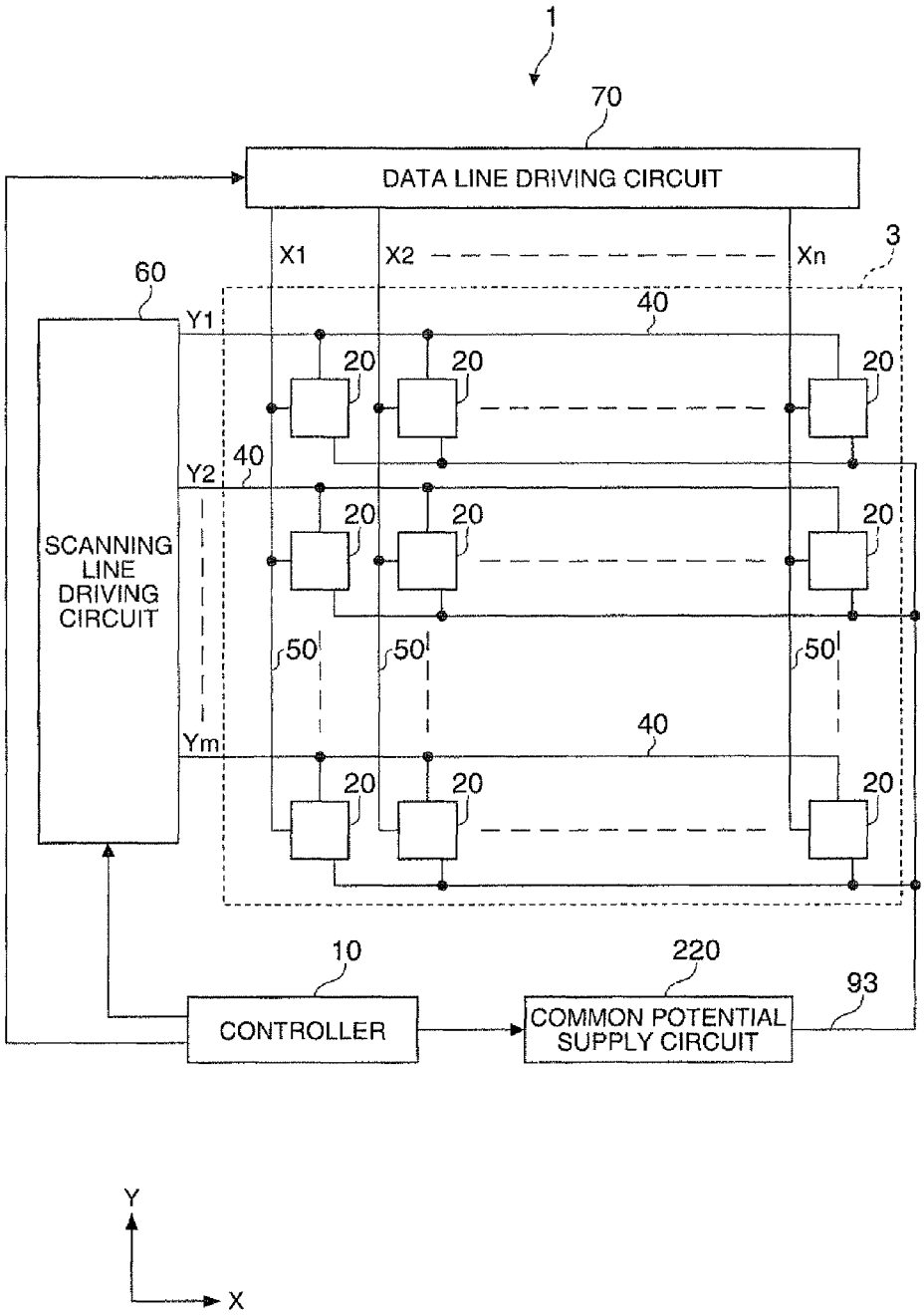
FIG. 1 is a block diagram showing the overall configuration of an electrophoretic display according to a first embodiment.

FIG. 1 is a block diagram showing the overall configuration of the electrophoretic display of this embodiment.

Referring to FIG. 1, an electrophoretic display 1 of this embodiment is an active matrix driving electrophoretic display, and includes a display section 3, a controller 10, a scanning line driving circuit 60, a data line driving circuit 70, and a common potential supply circuit 220. The controller 10 is an example of "a control device for an electro-optical device" described in the appended claims. The scanning line driving circuit 60 and the data line driving circuit 70 form an example of "a driving section" described in the appended claims.

The display section 3 has m rows×n columns pixels 20 in a matrix (two-dimensional plane). In the display section 3, m scanning lines 40 (that is, scanning lines Y1, Y2, . . . , and Ym) and n data lines 50 (that is, data lines X1, X2, . . . , and Xn) are provided to intersect each other. Specifically, the m scanning lines 40 extend in a row direction (that is, X direction), and the n data lines 50 extend in a column direction (that is, Y direction). The pixels 20 are arranged at the intersections of the m scanning lines 40 and the n data lines 50.

The controller 10 controls the scanning line driving circuit 60, the data line driving circuit 70, and the common potential supply circuit 220. For example, the controller 10 supplies timing signals, such as a clock signal and a start pulse, to the respective circuits.

The scanning line driving circuit 60 sequentially supplies a scanning signal to each of the scanning lines Y1, Y2, . . . , and Ym in a pulsed manner during a predetermined frame period under the control of the controller 10.

The data line driving circuit 70 supplies a data potential to the data lines X1, X2, . . . , and Xn under the control of the controller 10. The data potential is one of a reference potential GND (for example, 0 volt), a high potential VH (for example, +15 volt), and a low potential VL (for example, −15 volt). As described below, in this embodiment, the above-described partial rewrite driving is used. The low potential VL is an example of "a first gradation potential", and the high potential VH is an example of "a second gradation potential".

The common potential supply circuit 220 supplies a common potential Vcom (in this embodiment, the same potential as the reference potential GND) to common potential lines 93. The common potential Vcom may be a potential which is different from the reference potential GND in a range in which no voltage is substantially generated between a counter electrode 22 to which the common potential Vcom is supplied and a pixel electrode 21 to which the reference potential GND is supplied. For example, the common potential Vcom may have a value different from the reference potential GND supplied to the pixel electrode 21 taking into consideration variations in the potential on the pixel electrode 21 due to feedthrough. In this case, in this specification, the common potential Vcom is regarded as the same as the reference potential GND. The term "feedthrough" refers to the phenomenon in which, after the scanning signal is supplied to the scanning line 40, and the potential is supplied to the pixel electrode 21 through the data line 50, when the supply of the scanning signal to the scanning line 40 ends (for example, when the potential on the scanning line 40 decreases), the potential on the pixel electrode 21 varies (for example, decreases along with a decrease in the potential on the scanning line 40) due to parasitic capacitance between the pixel electrode 21 and the scanning line 40. Although previously assuming that the potential on the pixel electrode 21 decreases due to feedthrough, the common potential Vcom has a value slightly lower than the reference potential GND supplied to the pixel electrode 21, even in this case, the common potential Vcom and the reference potential GND are regarded as the same potential.

While various signals are input and output to and from the controller 10, the scanning line driving circuit 60, the data line driving circuit 70, and the common potential supply circuit 220, description of a configuration which is not particularly related to this embodiment will be omitted.

Figure 2:
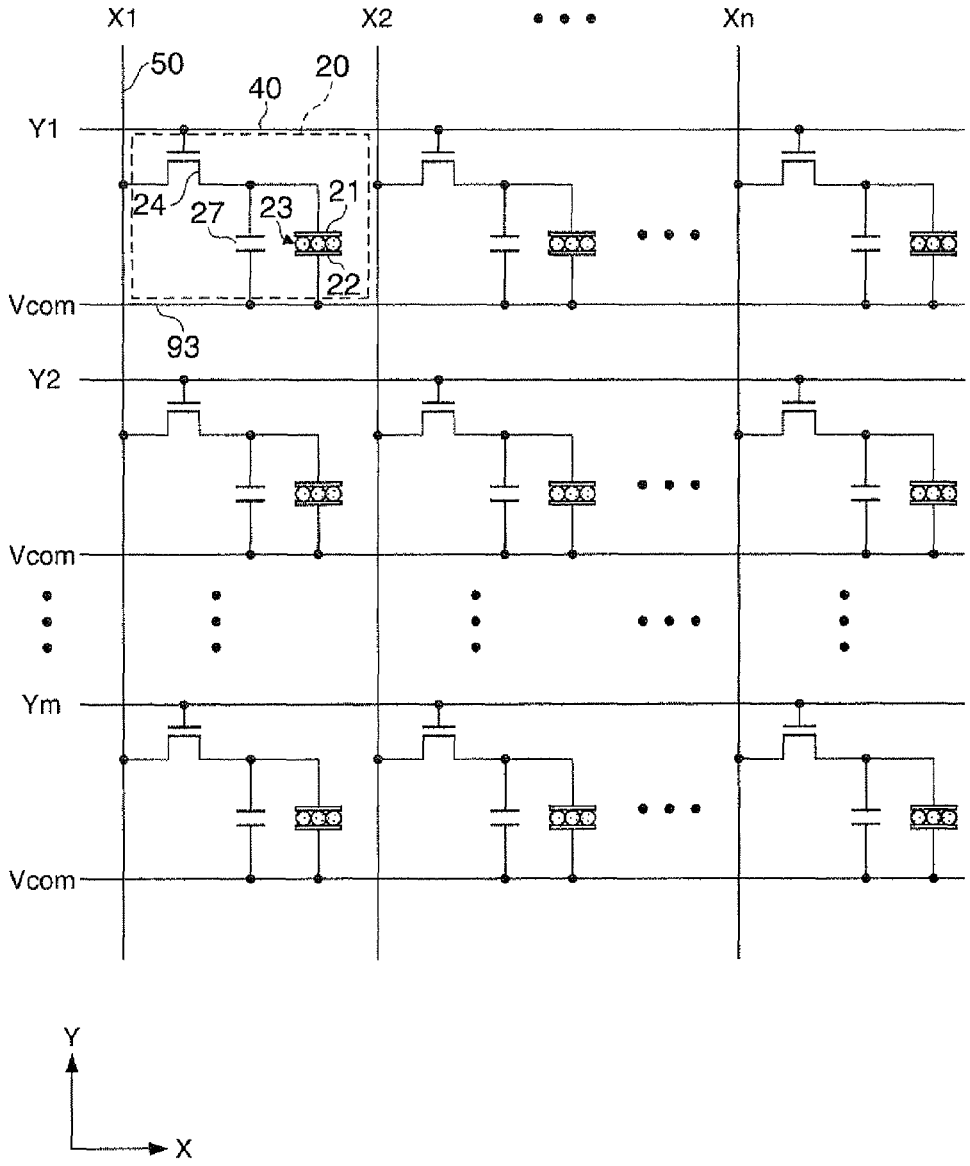
FIG. 2 is an equivalent circuit diagram showing the electrical configuration of a pixel according to the first embodiment.

FIG. 2 is an equivalent circuit diagram showing the electrical configuration of the pixel 20.

Referring to FIG. 2, the pixel 20 includes a pixel switching transistor 24, a pixel electrode 21, a counter electrode 22, an electrophoretic element 23, and a storage capacitor 27.

The pixel switching transistor 24 is, for example, an N-type transistor. The pixel switching transistor 24 has a gate electrically connected to the corresponding scanning line 40, a source electrically connected to the corresponding data line 50, and a drain electrically connected to the pixel electrode 21 and the storage capacitor 27. The pixel switching transistor 24 outputs the data potential, which is supplied from the data line driving circuit 70 (see FIG. 1) through the data line 50, to the pixel electrode 21 and the storage capacitor 27 at the timing based on the scanning signal supplied from the scanning line driving circuit 60 (see FIG. 1) through the scanning line 40 in a pulsed manner.

The pixel electrode 21 is supplied with the data potential from the data line driving circuit 70 through the data line 50 and the pixel switching transistor 24. The pixel electrode 21 is arranged to be opposite the counter electrode 22 through the electrophoretic element 23.

The counter electrode 22 is electrically connected to the corresponding common potential line 93 to which the common potential Vcom is supplied.

The electrophoretic element 23 has a plurality of microcapsules each including electrophoretic particles.

The storage capacitor 27 has a pair of electrodes arranged to be opposite each other through a dielectric film. One electrode is electrically connected to the pixel electrode 21 and the pixel switching transistor 24, and another electrode is electrically connected to the common potential line 93. It is possible to maintain the data potential for a predetermined period of time by the storage capacitor 27.

Next, the basic configuration of the display section in the electrophoretic display of this embodiment will be described with reference to FIG. 3.

Figure 3:
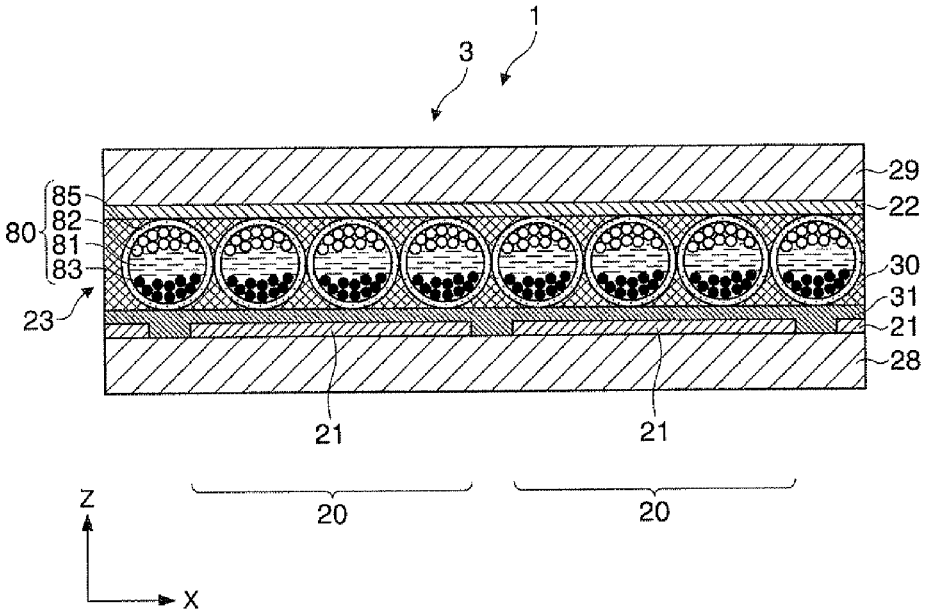
FIG. 3 is a partial sectional view of a display section in the electrophoretic display according to the first embodiment.

FIG. 3 is a partial sectional view of the display section 3 of the electrophoretic display 1.

Referring to FIG. 3, the display section 3 has a configuration in which the electrophoretic element 23 is sandwiched between an element substrate 28 and a counter substrate 29. In this embodiment, description will be provided assuming that an image is displayed on the counter substrate 29 side.

The element substrate 28 is a substrate which is made of, for example, glass, plastic, or the like. Though not shown, a laminated structure of the pixel switching transistor 24, the storage capacitor 27, the scanning line 40, the data line 50, the common potential line 93, and the like described with reference to FIG. 2 is formed on the element substrate 28. A plurality of pixel electrodes 21 are provided in a matrix on the upper layer side of the laminated structure.

The counter substrate 29 is a transparent substrate which is made of, for example, glass, plastic, or the like. On the surface of the counter substrate 29 opposite the element substrate 28, the counter electrode 22 is formed in a solid shape to be opposite a plurality of pixel electrodes 21. The counter electrode 22 is formed of, for example, a transparent conductive material, such as magnesium-silver (MgAg), indium tin oxide (ITO), or indium zinc oxide (IZO).

The electrophoretic element 23 has a plurality of microcapsules 80 each including electrophoretic particles, and is fixed between the element substrate 28 and the counter substrate 29 by a binder 30 and an adhesive layer 31 made of, for example, resin or the like. In the electrophoretic display 1 of this embodiment, during a manufacturing process, an electrophoretic sheet, in which the electrophoretic element 23 is previously fixed to the counter substrate 29 by the binder 30 is bonded to the element substrate 28, which is separately manufactured and on which the pixel electrodes 21 and the like are formed, by the adhesive layer 31.

One or a plurality of microcapsules 80 are sandwiched between the pixel electrode 21 and the counter electrode 22, and arranged in one pixel 20 (in other words, relative to one pixel electrode 21).

The microcapsules 80 encapsulate a dispersion medium 81, a plurality of white particles 82, and a plurality of black particles 83 inside a capsule 85. The microcapsules 80 are formed, for example in a spherical shape having a particle size of about 50 μm.

The capsule 85 functions as a shell of the microcapsule 80 and is formed of acrylic resin, such as polymethylmethacrylate or polyethyl methacrylate, or transmissive polymer resin, such as urea resin, Arabian gum, or gelatin.

The dispersion medium 81 is a medium which disperses the white particles 82 and the black particles 83 in the microcapsule 80 (in other words, in the capsule 85). As the dispersion medium 81, water, alcoholic solvents, such as methanol, ethanol, isopropanol, butanol, octanol, and methyl cellosolve, various esters, such as ethyl acetate, and butyl acetate, ketones, such as acetone, methyl ethyl ketone, and methyl isobutyl ketone, aliphatic hydrocarbons, such as pentane, hexane, and octane, alicyclic hydrocarbons, such as cyclohexane and methylcyclohexane, aromatic hydrocarbons, such as benzene, toluene, and benzenes having a long chain alkyl group, such as xylene, hexyl benzene, heptyl benzene, octylbenzene, nonyl benzene, decyl benzene, undecyl benzene, dodecyl benzene, tridecyl benzene, and tetradecyl benzene, halogenated hydrocarbons, such as methylene chloride, chloroform, carbon tetrachloride, and 1,2-dichloroethane, carboxylate, or other oils may be used alone or in combination. A surfactant may be mixed in the dispersion medium 81.

The white particles 82 are particles (polymer or colloid) which are made of, for example, a white pigment, such as titanium dioxide, Chinese white (zinc oxide), or antimony trioxide, and are, for example, negatively charged.

The black particles 83 are particles (polymer or colloid) which are made of, for example, a black pigment, such as aniline black or carbon black, and are, for example, positively charged.

For this reason, the white particles 82 and the black particles 83 can move in the dispersion medium 81 by an electric field which is generated by a potential difference between the pixel electrode 21 and the counter electrode 22.

If necessary, additives may be added to the pigments. Examples of the additives include an electrolyte, a surfactant, a charge control agent having particles of metal soap, resin, rubber, oil, varnish, or compound, a dispersant, such as a titanium-based coupling agent, an aluminum-based coupling agent, or a silane-based coupling agent, a lubricant, a stabilizer, and the like.

Referring to FIG. 3, when a voltage is applied between the pixel electrode 21 and the counter electrode 22 such that the potential on the counter electrode 22 becomes relatively high, the positively charged black particles 83 are attracted to the pixel electrode 21 side in the microcapsule 80 by a Coulomb's force, and the negatively charged white particles 82 are attracted to the counter electrode 22 side in the microcapsule 80 by a Coulomb's force. As a result, the white particles 82 are cumulated on the display surface side (that is, the counter electrode 22 side) in the microcapsule 80, and the color (that is, white) of the white particles 82 is displayed on the display surface of the display section 3. To the contrary, when a voltage is applied between the pixel electrode 21 and the counter electrode 22 such that a potential on the pixel electrode 21 becomes relatively high, the negatively charged white particles 82 are attracted to the pixel electrode 21 side by a Coulomb's force, and the positively charged black particles 83 are attracted to the counter electrode 22 side by a Coulomb's force. As a result, the black particles 83 are cumulated on the display surface side in the microcapsule 80, and the color (that is, black) of the black particles 83 is displayed on the display surface of the display section 3.

The pigments which are used in the white particles 82 and the black particles 83 may be substituted with pigments of red, green, blue, and the like, and red, green, blue, and the like may be displayed.

Control Method

Next, a method of controlling an electrophoretic display of this embodiment will be described with reference to FIGS. 4 to 13.

First, blurring which occurs during image rewriting will be described with reference to FIGS. 4 to 7. The following description will be provided as to an example where a two-gradation image having two gradations of black and white is rewritten.

Figure 4:
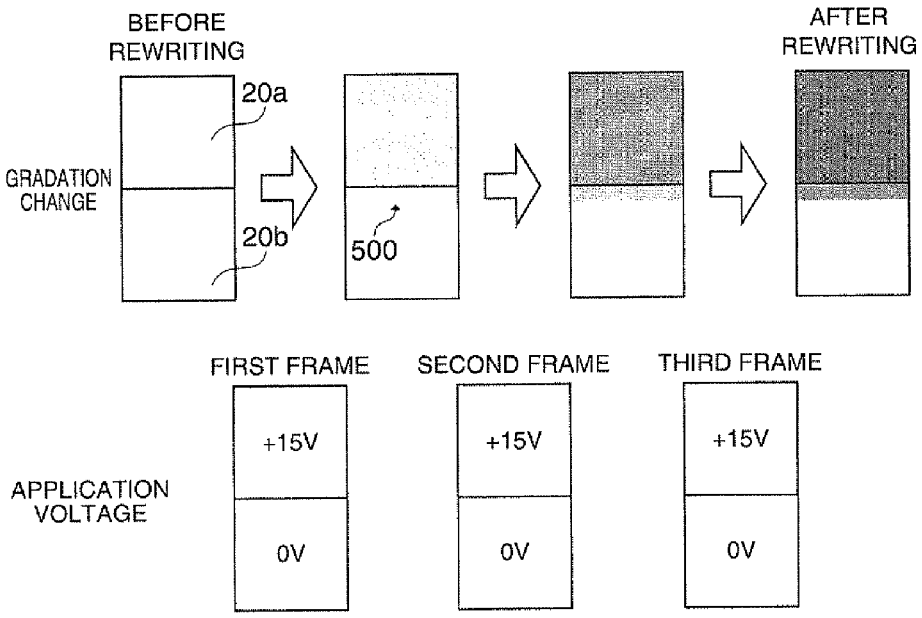
FIG. 4 is a plan view (first view) showing a display gradation and a driving voltage in each frame period during image rewriting according to a comparative example.

FIG. 4 is a plan view (first view) showing a display gradation and a driving voltage in each frame period during image rewriting according to a comparative example.

In FIG. 4, a case where, in a state where both of adjacent pixels 20*a* (first pixel) and a pixel 20*b* (second pixel) display white, only the pixel 20*a* is rewritten to display black is considered. In this case, the high potential VH (for example, +15 V) for displaying black is supplied as a data potential to the pixel 20*a* where the gradation to be displayed is changed over three frame periods. Accordingly, in regard to the pixel 20*a* which displays white, the image is rewritten to black in a stepwise manner in terms of frame periods.

The frame period is a period which is determined in advance and in which m scanning lines are sequentially selected once. That is, in each frame period, the supply of the data potential to the pixel electrode 21 of each of a plurality of pixels 20 is performed once by the scanning line driving circuit 60 and the data line driving circuit 70 (hereinafter, the scanning line driving circuit 60 and the data line driving circuit 70 are collectively referred to as "a driving section") under the control of the controller 10. Accordingly, the image displayed in the display section 3 is rewritten in a stepwise manner.

The reference potential GND (for example, 0 V) which is the same potential as the potential on the counter electrode is supplied to the pixel 20*b* where the gradation to be displayed is not changed over three frames. When this happens, since no voltage is applied to the pixel 20*b*, white display is held.

However, if the supply of the data potential is performed in the above-described manner, for example, a blurred portion 500 in which a color, such as grey, approaching black from white is displayed is generated near the boundary between the pixel 20*a* where the gradation is changed and the pixel 20*b* where the gradation is not changed. Hereinafter, the principle of the occurrence of blurring will be described with reference to FIG. 5.

Figure 5:
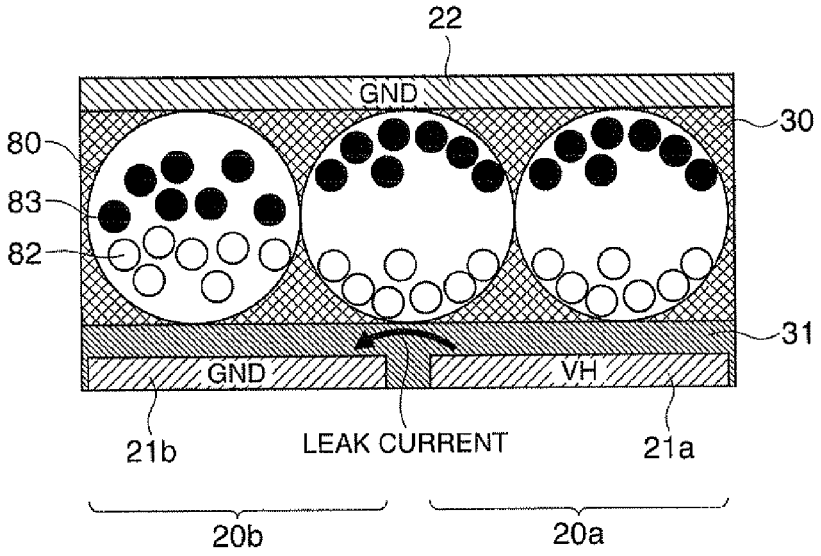
FIG. 5 is a schematic view illustrating the occurrence of blurring of a boundary of an image displayed in a display section.

FIG. 5 is a schematic view illustrating the occurrence of blurring of a boundary of an image displayed in the display section.

As shown in FIG. 5, if the high potential VH is supplied to a pixel electrode 21*a* of a pixel 20*a* as the data potential, and the reference potential GND is supplied to a pixel electrode 21*b* of a pixel 20*b* adjacent to the pixel 20*a* as the data potential, when the pixel switching transistor 24 (see FIG. 2) is turned off, a leak current may be generated between the pixel electrode 21*a* and the pixel electrode 21*b*, and the potential on the pixel electrode 21*b* whose potential has been the reference potential GND may increase (that is, may approach the high potential VH). Accordingly, the black particles 83 may move toward the counter electrode 22 and the white particles may move toward the pixel electrode 21*b* due to the potential difference between the pixel electrode 21*b* and the counter electrode 22 in the pixel 20*b*. For this reason, a color, such as grey or black, different from white may be displayed in the pixel 20*b* which should display white. As a result, blurring of the boundary between the black image portion and the white image portion may occur in the image displayed in the display section 3.

Figure 6:
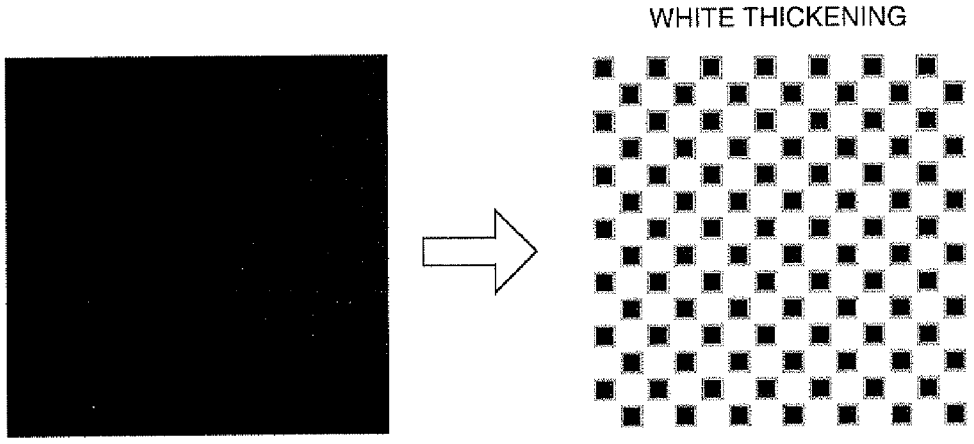
FIG. 6 is a plan view (first view) showing an example of an area gradation residual image.
Figure 7:
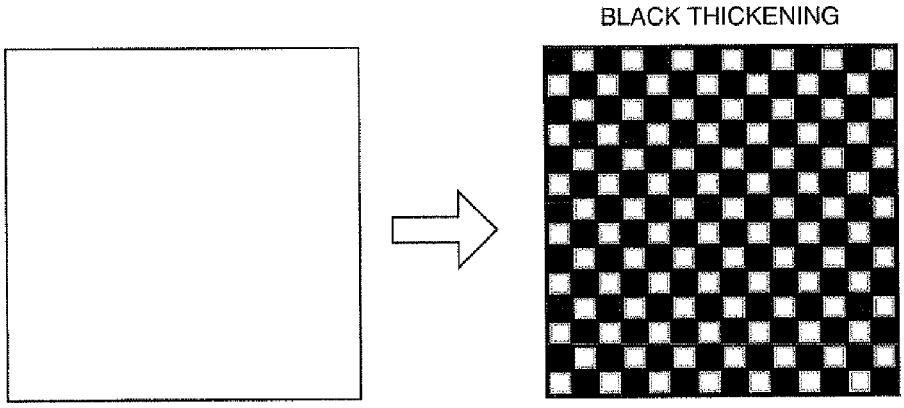
FIG. 7 is a plan view (second view) showing an example of an area gradation residual image.

FIGS. 6 and 7 are plan views showing an example of an area gradation residual image.

As shown in FIG. 6, for example, when a full black image is rewritten to an intermediate-gradation image in which white and black are arranged in a checkered pattern with the same area, blurring occurs, resulting in a phenomenon (so-called white thickening) in which the area of white is greater than the area of black.

As shown in FIG. 7, for example, when a full white image is rewritten to an intermediate-gradation image, blurring occurs, resulting in a phenomenon (so-called black thickening) in which the area of black is greater than the area of white.

As described above, if blurring occurs, even when the same intermediate gradation is intended to be displayed, a resultant gradation value to be displayed differs, and this is visually recognized as an area gradation residual image. According to the method of controlling an electrophoretic display of this embodiment, it is possible to suppress the occurrence of blurring.

Hereinafter, a method of controlling an electrophoretic display of this embodiment will be described with reference to FIGS. 8 and 9.

Figure 8:
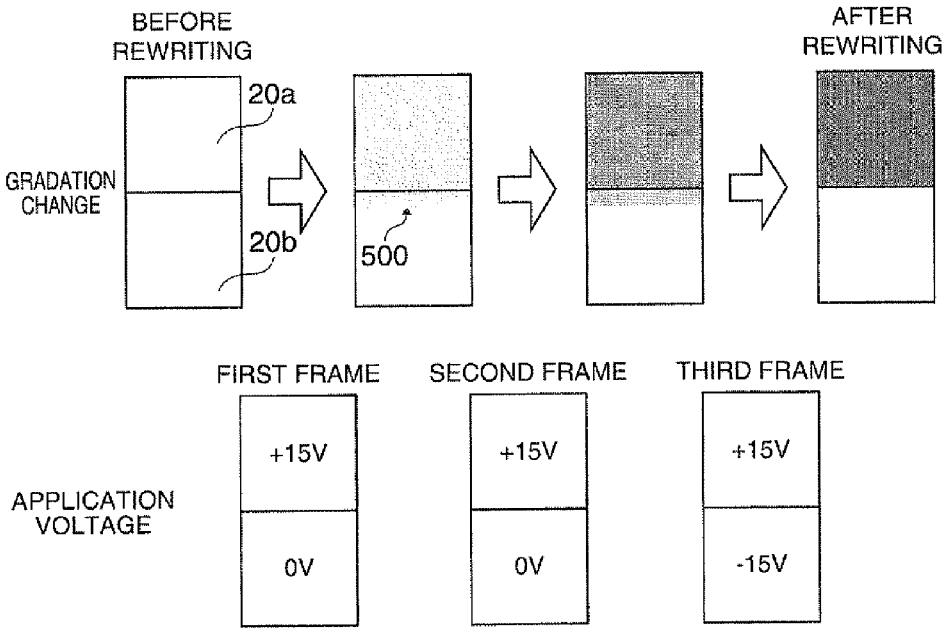
FIG. 8 is a plan view (first view) showing a display gradation and a driving voltage in each frame period during image rewriting according to the first embodiment.

FIG. 8 is a plan view (first view) showing a display gradation and a driving voltage in each frame period during image rewriting according to this embodiment.

Referring to FIG. 8, in the electrophoretic display 1 of this embodiment, when, in a state where both of adjacent pixels 20*a* and 20*b* display white, only the pixel 20*a* is rewritten to display black, the following data potential supply is performed in each frame period.

That is, in the first frame period and the second frame period, as in the comparative example (see FIG. 4), the high potential VH (for example, +15 V) corresponding to black is supplied to the pixel 20*a* where the gradation should be changed, and the reference potential GND (for example, 0 V) is supplied to the pixel 20*b* where the gradation should be held.

After this data potential supply has been performed in the first frame period and the second frame period, a color, such as grey, somewhat approaching black from white is displayed in the pixel 20*a* where white should be changed to black. Meanwhile, white is continuously displayed in the pixel 20*b* where white should be held. In this step, as in the comparative example, the blurred portion 500 is generated near the boundary between the pixels 20*a* and 20*b*.

In this embodiment, in particular, in the third frame period subsequent to the first frame period and the second frame period, the high potential VH (for example, +15 V) is supplied to the pixel 20*a* where the gradation should be changed, and the low potential VL (for example, −15 V) corresponding to white is supplied to the pixel 20*b* where the gradation should be held. Accordingly, the pixel 20*b* is driven to be close to white, and as a result, the blurred portion 500 which is generated near the pixel 20*a* and the pixel 20*b* is erased or thinned to be visually unrecognizable. Therefore, it is possible to display a clear image and to suppress the occurrence of the area gradation residual image shown in FIGS. 6 and 7.

In this embodiment, an operation to supply the high potential VH to the pixel 20*a* in the first frame period to the third frame period corresponds to a first control operation. An operation to supply the reference potential GND to the pixel 20*b* in the first and second frame periods corresponds to a second control operation. An operation to supply the low potential VL to the pixel 20*b* in the third frame period corresponds to a third control operation.

From the viewpoint of blurring erasure, as shown in FIG. 8, it is preferable that a potential corresponding to white is supplied to the pixel 20*b* in the third frame period which is the last frame period from among the frame periods necessary for rewriting. Even when a potential corresponding to white is supplied to the pixel 20*b* in a different frame period (for example, the second frame period or the like), the above-described effect is correspondingly obtained.

Figure 9:
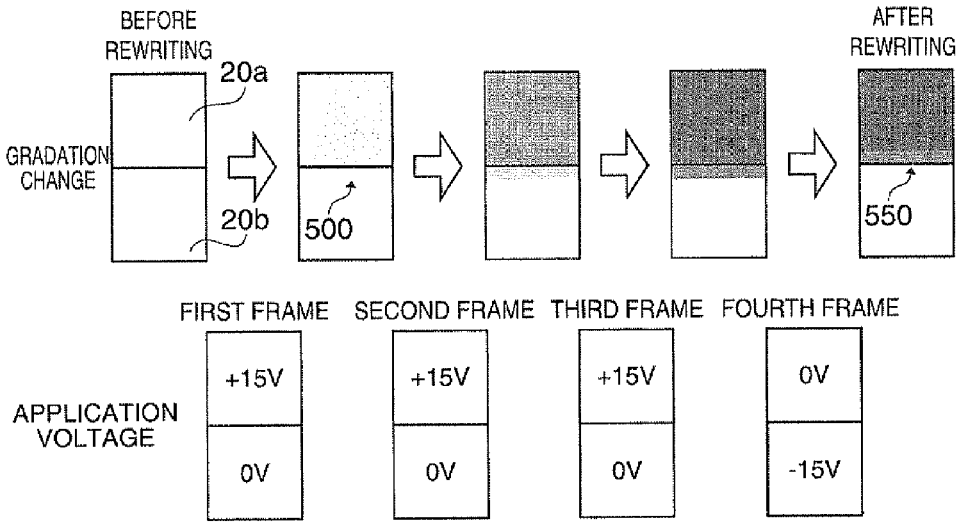
FIG. 9 is a plan view (second view) showing a display gradation and a driving voltage in each frame period during image rewriting according to the first embodiment.

FIG. 9 is a plan view (second view) showing a display gradation and a driving voltage in each frame period during image rewriting according to this embodiment.

As shown in FIG. 9, in the electrophoretic display 1 of this embodiment, when, in a state where both of adjacent pixels 20*a* and 20*b* display white, only the pixel 20*a* is rewritten to display black, the following data potential supply may be performed in each frame period.

That is, in the first frame period to the third frame period, as in the comparative example (see FIG. 4), the high potential VH (for example, +15 V) corresponding to black is supplied to the pixel 20*a* where the gradation should be changed, and the reference potential GND (for example, 0 V) is supplied to the pixel 20*b* where the gradation should be held. For this reason, the blurred portion 500 is generated near the boundary between the pixels 20*a* and 20*b* immediately after the image has been rewritten.

In this embodiment, in particular, in the fourth frame period immediately after the third frame period, the reference potential GND (for example, 0 V) is supplied to the pixel 20*a* where the gradation has been changed, and the low potential VL (for example, −15 V) corresponding to white is supplied to the pixel 20*b* where the gradation has been held. Accordingly, the pixel 20*a* is maintained black after rewriting, and the pixel 20*b* is driven to be close to white. Therefore, it is possible to erase the blurred portion 500 near the boundary between the pixel 20*a* and the pixel 20*b* or to thin the blurred portion 500 to be visually unrecognizable without changing the gradation of the pixel 20*a* which has already been rewritten.

In this embodiment, an operation to supply the high potential VH to the pixel 20*a* in the first frame period to the third frame period corresponds to a first control operation. An operation to supply the reference potential GND to the pixel 20*b* in the first frame period to the third frame period corresponds to a second control operation. An operation to supply the low potential VL to the pixel 20*b* in the fourth frame period corresponds to a third control operation. An operation to supply the reference potential GND to the pixel 20*a* in the fourth frame period corresponds to a fourth control operation.

A region which has displayed black may be close to white on the pixel 20*a* near the boundary between the pixels 20*a* and 20*b* due to rewriting in the fourth frame period, and a blurred portion 550 may be generated. Meanwhile, since the blurred portion 550 is generated in the fourth frame period, the blurred portion 550 is very thin compared to the blurred portion 500. Accordingly, the blurred portion 550 little affects image quality.

As described above with reference to FIGS. 8 and 9, according to the method of controlling an electrophoretic display of this embodiment, it is possible to effectively reduce blurring which occurs during image rewriting.

Next, an edge residual image which is due to blurring having already occurred during image rewriting will be described with reference to FIGS. 10 and 11.

Figure 10:
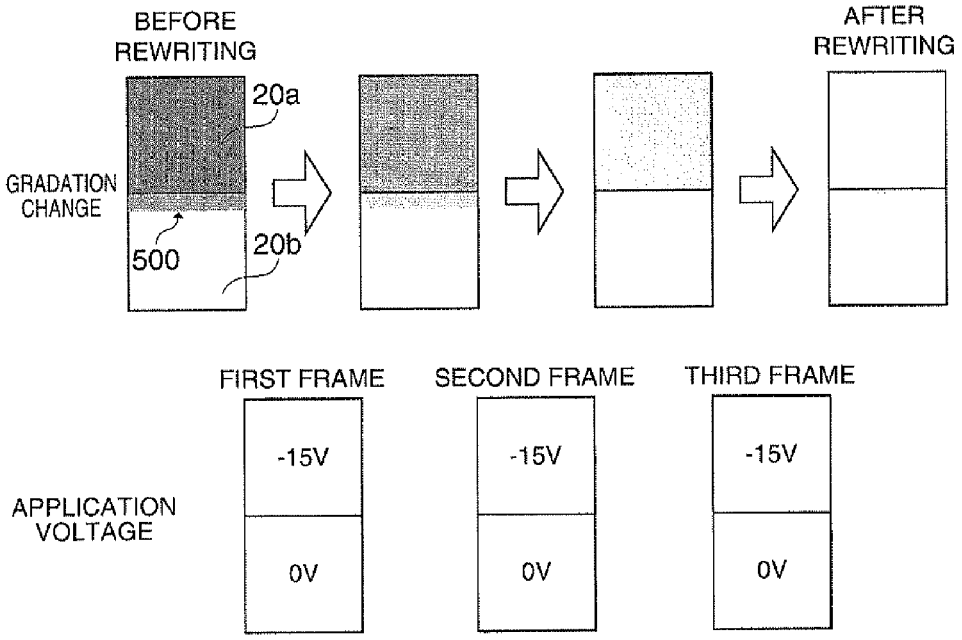
FIG. 10 is a plan view (second view) showing a display gradation and a driving voltage in each frame period during image rewriting according to the comparative example.

FIG. 10 is a plan view (second view) showing a display gradation and a driving voltage in each frame period during image rewriting according to the comparative example.

In FIG. 10, a case where, in a state where the pixel 20*a* displays black and the pixel 20*b* adjacent to the pixel 20*a* displays white, both the pixels 20*a* and 20*b* are rewritten to display white (more properly, only the gradation of the pixel 20*a* is changed to white) is considered. In this case, the low potential VL (for example, −15 V) for displaying white is supplied to the pixel 20*a*, in which the gradation to be displayed is changed, as the data potential over three frame periods. Accordingly, in regard to the pixel 20*a* which has displayed black, an image is rewritten to white in a stepwise manner in terms of frame periods.

The reference potential GND (for example, 0 V) which is the same potential as the counter electrode is supplied to the pixel 20*b*, in which the gradation to be displayed is not changed, over three frames. When this happens, since no voltage is applied to the pixel 20*b*, white display is held.

Meanwhile, in the above-described data potential supply, since no voltage is applied to the blurred portion 500 which has occurred before image rewriting, even when the rewriting of the pixel 20*a* has ended, the blurred portion 500 may remain. In this case, the blurred portion 500 is visually recognized as an edge residual image.

Figure 11:
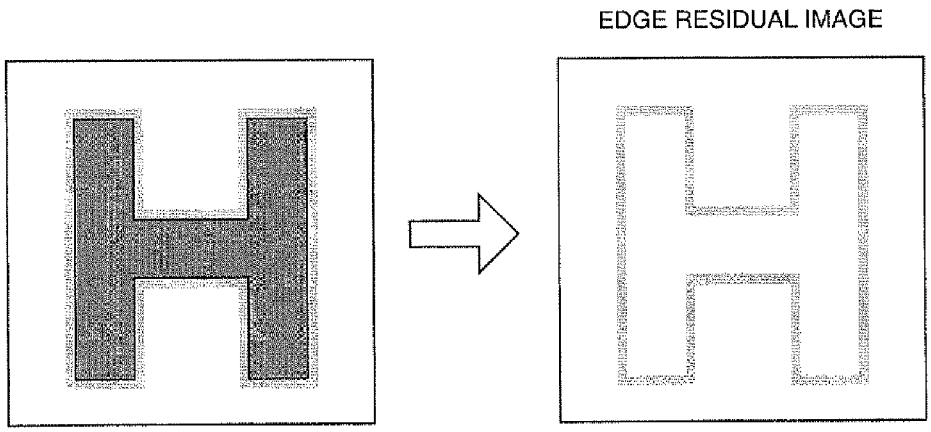
FIG. 11 is a plan view showing an example of an edge residual image.

FIG. 11 is a plan view showing an example of an edge residual image.

As shown in FIG. 11, for example, it is assumed that, in a state where a character "H" is displayed with black in a white background, rewriting to a full white image is performed. In this case, while the region of the character "H" to which a voltage is applied is changed to white, since no voltage is applied to the background portion which has displayed white before rewriting, blurring in the edge portion of the character "H" remains unchanged or somewhat thinned. As a result, an edge residual image shown in the drawing is generated in the full white image after rewriting. According to the method of controlling an electrophoretic display of this embodiment, it is possible to suppress the occurrence of the edge residual image.

Hereinafter, another method of controlling an electrophoretic display of this embodiment will be described with reference to FIGS. 12 and 13.

Figure 12:
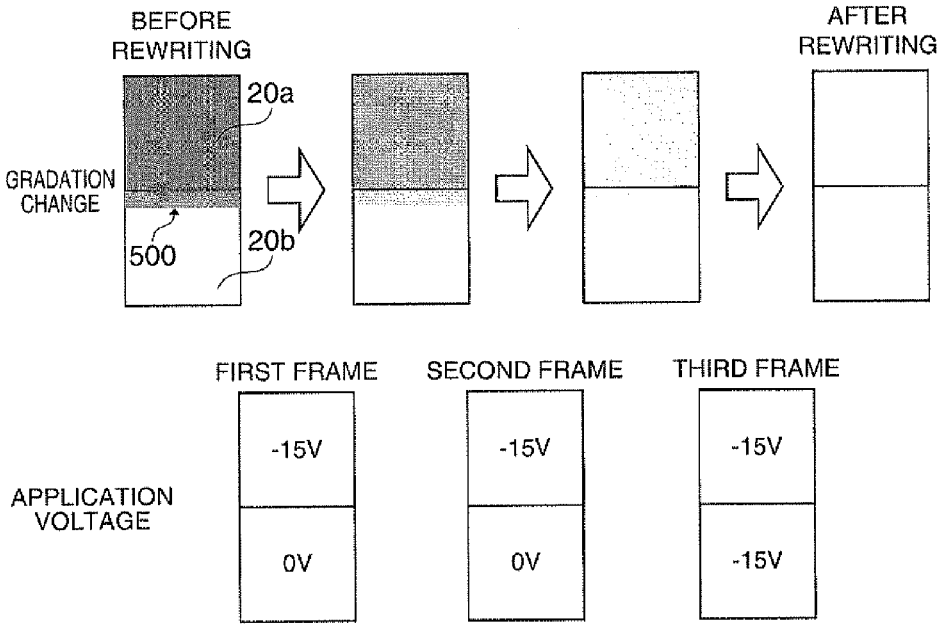
FIG. 12 is a plan view (third view) showing a display gradation and a driving voltage in each frame period during image rewriting according to the first embodiment.

FIG. 12 is a plan view (third view) showing a display gradation and a driving voltage in each frame period during image rewriting according to this embodiment.

Referring to FIG. 12, in the electrophoretic display 1 of this embodiment, when, in a state where the pixel 20*a* displays black and the pixel 20*b* adjacent to the pixel 20*a* displays white, both the pixels 20*a* and 20*b* are rewritten to display white, the following data potential supply is performed in each frame period.

That is, in the first frame period and the second frame period, as in the comparative example (see FIG. 10), the low potential VL (for example, −15 V) corresponding to white is supplied to the pixel 20*a* where the gradation should be changed, and the reference potential GND (for example, 0 V) is supplied to the pixel 20*b* where the gradation should be held.

After this data potential supply has been performed in the first frame period and the second frame period, a color, such as grey, somewhat approaching white from black is displayed in the pixel 20*a* where black should be changed to white. Meanwhile, white is continuously displayed in the pixel 20*b* where white should be held. In this step, as in the comparative example, the blurred portion 500 remains near the boundary between the pixels 20*a* and 20*b*.

In this embodiment, in particular, in the third frame period subsequent to the first frame period and the second frame period, the low potential VL (for example, −15 V) corresponding to white is supplied to the pixel 20*a* where the gradation should be changed, and the low potential VL (for example, −15 V) corresponding to white is supplied to the pixel 20*b* where the gradation should be held. Accordingly, the pixel 20*b* is driven to be close to white, and as a result, the blurred portion 500 which has occurred near the pixel 20*a* and the pixel 20*b* is erased or thinned to be visually unrecognizable. Therefore, it is possible to suppress the occurrence of the edge residual image shown in FIG. 11.

In this embodiment, an operation to supply the low potential VL to the pixel 20*a* in the first frame period to the third frame period corresponds to a first control operation. An operation to supply the reference potential GND to the pixel 20*b* in the first and second frame periods corresponds to a second control operation. An operation to supply the low potential VL to the pixel 20*b* in the third frame period corresponds to a third control operation.

Figure 13:
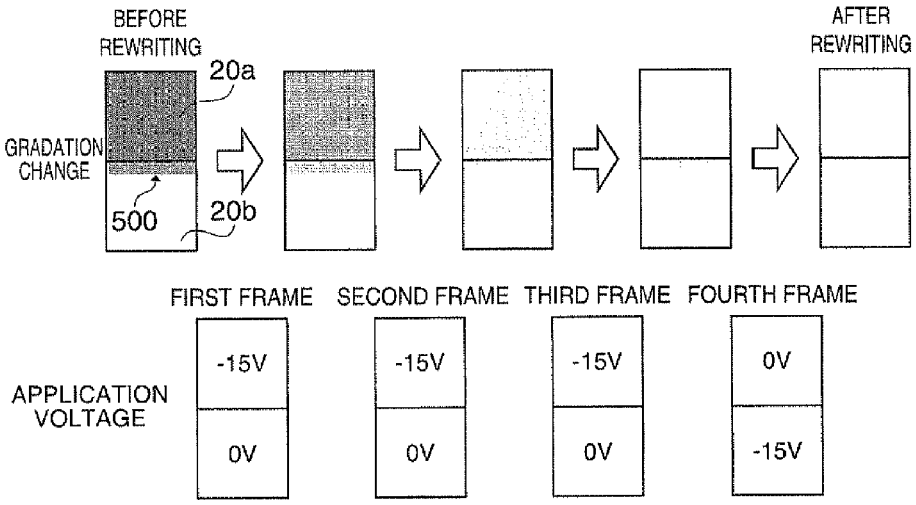
FIG. 13 is a plan view (fourth view) showing a display gradation and a driving voltage in each frame period during image rewriting according to the first embodiment.

FIG. 13 is a plan view (fourth view) showing a display gradation and a driving voltage in each frame period during image rewriting according to this embodiment.

As shown in FIG. 13, in the electrophoretic display 1 of this embodiment, when, in a state where the pixel 20*a* displays black and the pixel 20*b* adjacent to the pixel 20*a* displays white, both the pixels 20*a* and 20*b* are rewritten to display white, the following data potential supply may be performed in each frame period.

That is, in the first frame period to the third frame period, as in the comparative example (see FIG. 10), the low potential VL (for example, −15 V) corresponding to white is supplied to the pixel 20*a* where the gradation should be changed, and the reference potential GND (for example, 0 V) is supplied to the pixel 20*b* where the gradation should be held. For this reason, immediately after an image is rewritten, the blurred portion 500 remains near the boundary between the pixels 20*a* and 20*b*.

In this embodiment, in particular, in the fourth frame period immediately after the third frame period, the reference potential GND (for example, 0 V) is supplied to the pixel 20*a* where the gradation has been changed, and the low potential VL (for example, −15 V) corresponding to white is supplied to the pixel 20*b* where the gradation has been held. Accordingly, when the pixel 20*a* is held white after rewriting, and the pixel 20*b* is driven to be close to white. Therefore, it is possible to erase the blurred portion 500 which has occurred near the pixel 20*a* and the pixel 20*b* or to thin the blurred portion 500 to be visually unrecognizable without changing the gradation of the pixel 20*a* which has already been rewritten.

In this embodiment, an operation to supply the low potential VL to the pixel 20*a* in the first frame period to the third frame period corresponds to a first control operation. An operation to supply the reference potential GND to the pixel 20*b* in the first frame period to the third frame period corresponds to a second control operation. An operation to supply the low potential VL to the pixel 20*b* in the fourth frame period corresponds to a third control operation. An operation to supply the reference potential GND to the pixel 20*a* in the fourth frame period corresponds to a fourth control operation.

As described above with reference to FIGS. 12 and 13, according to the method of controlling an electrophoretic display of this embodiment, it is possible to effectively reduce an edge residual image which occurs during image rewriting.

Although in the method of controlling an electrophoretic display of this embodiment described with reference to FIGS. 8 and 9 and FIGS. 12 and 13, the driving for erasing blurring (that is, the driving in the third frame period of FIGS. 8 and 12 and the driving in the fourth frame period of FIGS. 9 and 13) are performed only in one frame period, the driving for erasing blurring may be performed in a plurality of frame periods. If the driving for erasing blurring is shortened, it is possible to suppress or prevent collapse of the DC balance ratio (that is, the ratio of the time for which a voltage (that is, the potential difference between the low potential VL and the reference potential GND) based on white is applied between the pixel electrode 21 and the counter electrode 22 and the time for which a voltage (that is, the potential difference between the high potential VH and the reference potential GND) based on black is applied between the pixel electrode 21 and the counter electrode 22) in the pixel 20. That is, in regard to each pixel 20, it is possible to reduce the difference between the time for which a voltage based on white is applied between the pixel electrode 21 and the counter electrode 22 and the time for which a voltage based on black is applied.

As another method of suppressing or preventing collapse of the DC balance ratio in the pixel 20, it is also effective to make a voltage for erasing blurring lower than a voltage which is use in normal rewriting. That is, it is preferable that the absolute value of the difference between the potential supplied to the pixel electrode of the pixel 20*b* (second pixel) during the third control operation and the potential on the counter electrode 22 is smaller than the absolute value of the difference between the pixel electrode of the pixel 20*a* (first pixel) during the first control operation and the potential on the counter electrode 22. Specifically, the absolute value of the voltage of the driving for erasing blurring to the pixel 20*b* of FIGS. 8 and 9 and FIGS. 12 and 13 (that is, the driving in the third frame period to the pixel 20*b* of FIGS. 8 and 12 and the driving in the fourth frame period to the pixel 20*b* of FIGS. 9 and 13) is smaller than the absolute value (15 V) of the driving voltage in the pixel 20*a*. For example, −5 V or the like may be applied as the driving voltage for erasing blurring in the pixel 20*b*.

In order to prevent the DC balance ration from being collapsed, when the driving for erasing blurring is performed, driving for cancelling the collapse of the DC balance ratio may be performed during subsequent image rewriting. Specifically, during subsequent image rewriting, the low potential VL corresponding to white may be applied more as much as one frame period to the pixel 20, to which the high potential VH corresponding to black is applied more as much as one frame period to erase blurring. In this example, an operation to supply the low potential VL corresponds to a fifth control operation.

The number of times of driving for erasing blurring is limited, thereby suppressing collapse of the DC balance. Specifically, if the number of times of driving for erasing blurring per predetermined period is limited, it is possible to suppress collapse of the DC balance due to continuous driving for erasing blurring in a short time.

In the electrophoretic display, the degree of blurring occurrence may differ between white and black such that the white particles 82 and the black particles 83 are different in the moving velocity. In this case, the intensity differs between the driving for erasing blurring relative to white and the driving for erasing blurring relative to black, making it possible to more appropriately erase blurring. For example, when white blurring is generated with difficulty compared to black, in the driving for erasing white blurring, it is preferable to decrease a voltage to be applied and to reduce the number of frame periods.

As described above, according to the electrophoretic display 1 of this embodiment, it is possible to effectively suppress the occurrence of blurring of the boundary of the image displayed in the display section 3, thereby suppressing the occurrence of the edge residual image. Therefore, it becomes possible to display a high-quality image.

Second Embodiment

Figure 14:
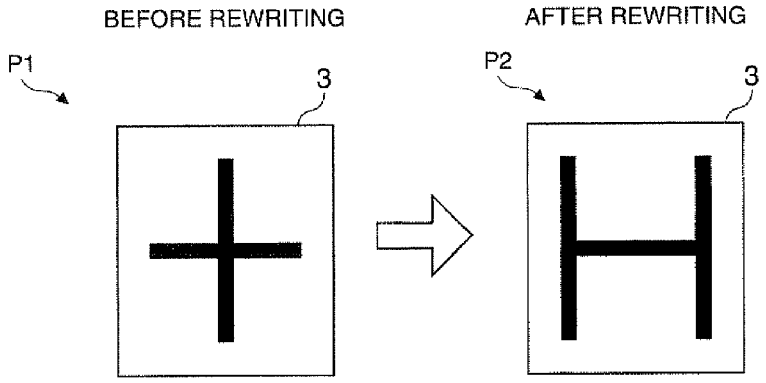
FIG. 14 is a plan view showing an example an image before rewriting and an image after rewriting according to a second embodiment.

Next, a method of controlling a electrophoretic display according to a second embodiment will be described with reference to FIGS. 14 to 17. Hereinafter, as shown in FIG. 14, the method of controlling the electrophoretic display 1 will be described as to an example where an image displayed in the display section 3 is rewritten from an image P1 to an image P2. Each of the images P1 and P2 is a two-gradation image having two gradations of black and white. FIG. 14 is a plan view showing an example of the image P1 before rewriting and the image P2 after rewriting.

Figure 15:
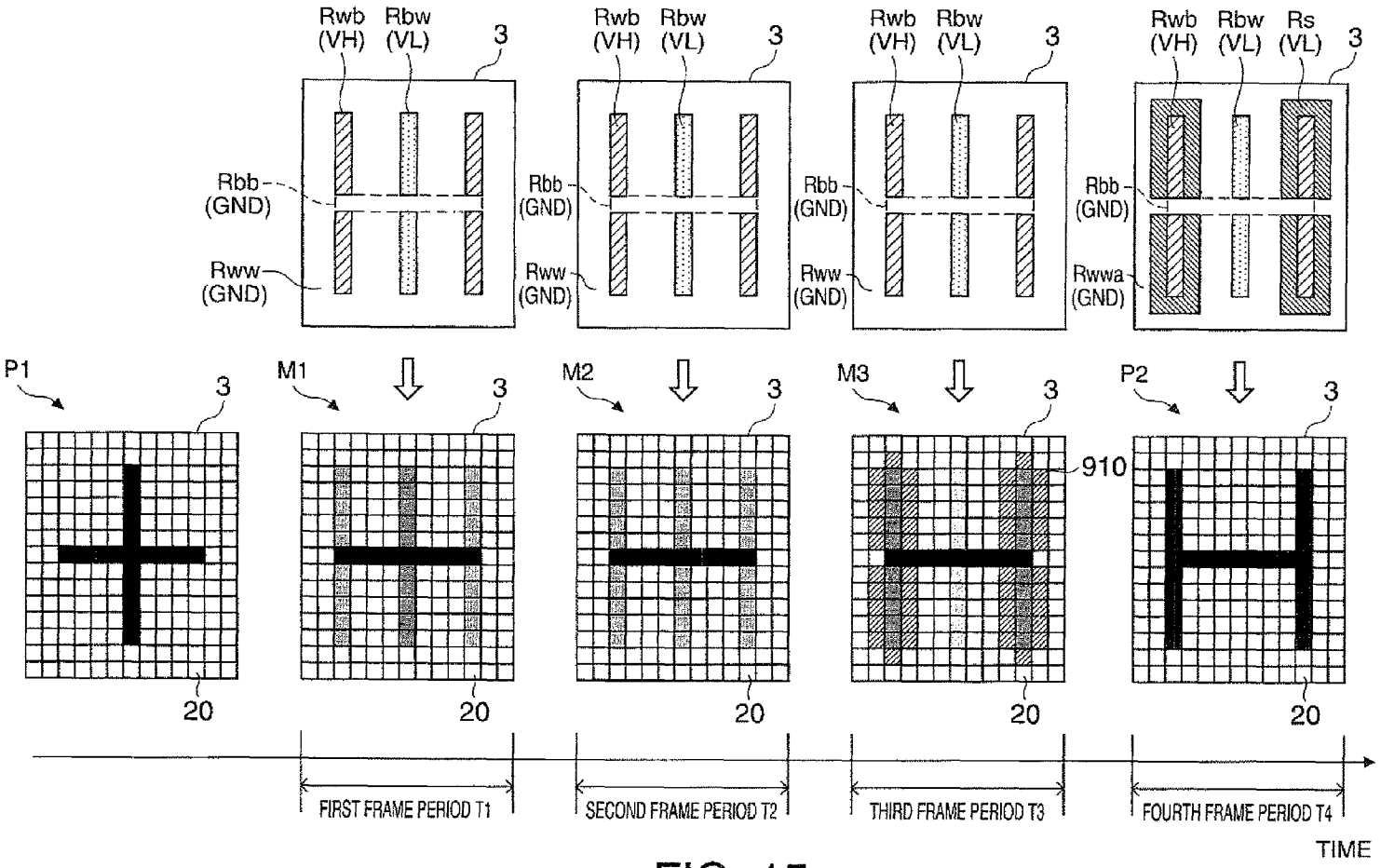
FIG. 15 is a conceptual diagram conceptually showing a method of supplying a data potential to a plurality of pixel electrodes during image rewriting in an electrophoretic display according to the second embodiment.

FIG. 15 is a conceptual diagram conceptually showing a method of supplying the data potential to a plurality of pixel electrodes 21 during image rewriting in the electrophoretic display 1. FIG. 15 conceptually shows the data potential, which is supplied to a plurality of pixel electrodes 21 in each of a plurality of frame periods T1, T2, T3, and T4, on the upper side. On the lower side of FIG. 15, an image which is displayed in the display section 3 when the data potential is supplied to a plurality of pixel electrodes 21 in each of the frame periods T1, T2, T3, and T4 is conceptually shown.

As shown in FIG. 15, in this embodiment, when the image displayed in the display section 3 is rewritten from the image P1 to the image P2, in each of the four frame periods T1, T2, T3, and T4, the data potential based on image data of the images P1 and P2 is supplied to the pixel electrode 21 of each of a plurality of pixels 20, such that the image P2 is displayed in the display section 3. The frame periods T1, T2, T3, and T4 are the periods which are determined in advance and in which m scanning lines are sequentially selected once. That is, in each of the frame periods T1, T2, T3, and T4, the supply (hereinafter, referred to as "data potential supply") of the data potential to the pixel electrode 21 of each of a plurality of pixels 20 is performed once by the scanning line driving circuit 60 and the data line driving circuit 70 (hereinafter, the scanning line driving circuit 60 and the data line driving circuit 70 are collectively referred to as "a driving section") under the control of the controller 10, such that the image displayed in the display section 3 is rewritten from the image P1 to the image P2.

Next, the data potential supply in each of the frame periods T1, T2, T3, and T4 will be described with reference to FIGS. 16 and 17, in addition to FIG. 15.

Figure 16:
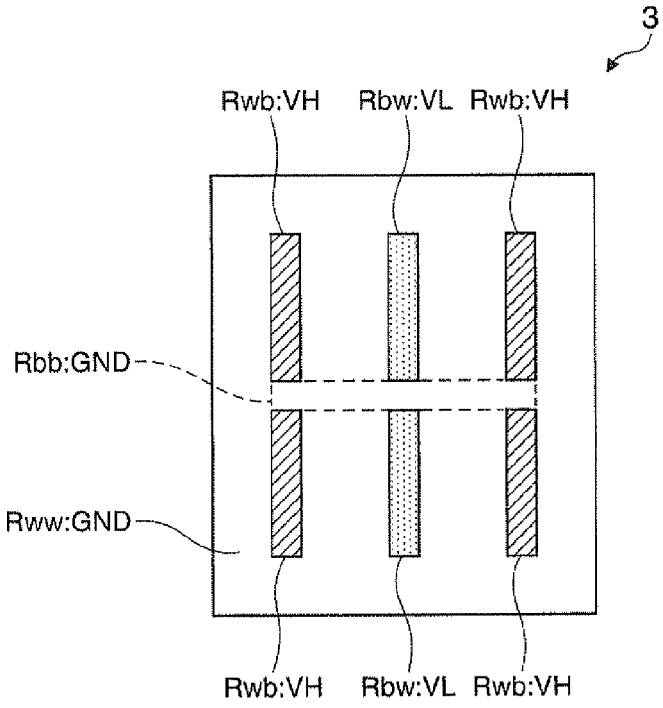
FIG. 16 is a conceptual diagram conceptually showing data potential supply in a first frame period T1 according to the second embodiment.
Figure 17:
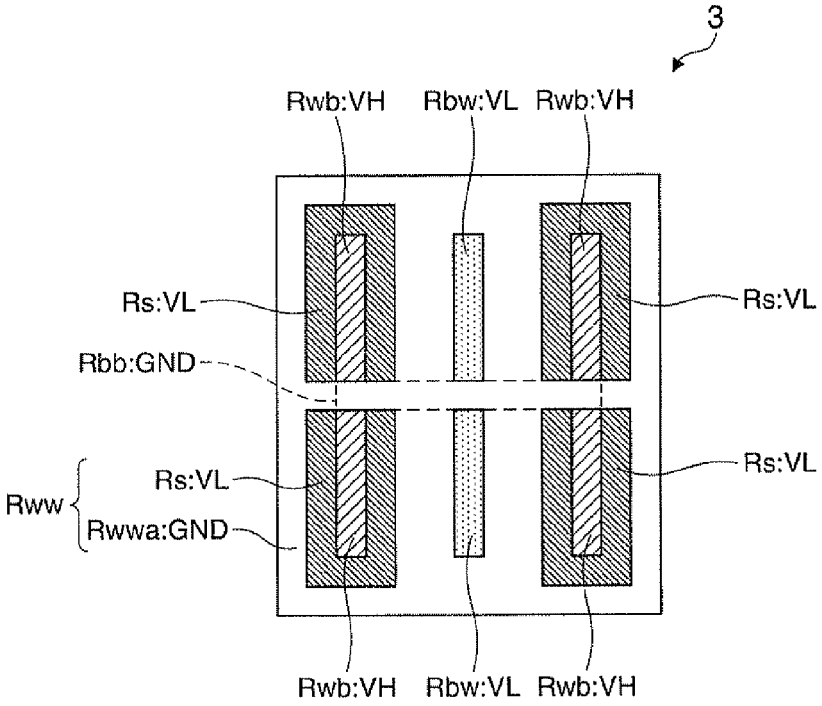
FIG. 17 is a conceptual diagram conceptually showing data potential supply in a fourth frame period T4 according to the second embodiment.

FIG. 16 is a conceptual diagram conceptually showing the data potential supply in the first frame period T1. FIG. 17 is a conceptual diagram conceptually showing the data potential supply in the fourth frame period T4. In this embodiment, in each of the second frame period T2 and the third frame period T3, the same data potential supply as in the first frame period T1 is performed.

Referring to FIGS. 15 and 16, when the image displayed in the display section 3 is rewritten from the image P1 to the image P2, first, in the first frame period T1, the following data potential supply is performed. The data potential supply is performed by the driving section (that is, the scanning line driving circuit 60 and the data line driving circuit 70) under the control of the controller 10.

That is, in the first frame period T1, the high potential VH (for example, +15 volt) is supplied as the data potential to the pixel electrode 21 of the pixel 20 corresponding to a region Rwb where the gradation to be displayed is changed from white to black. The low potential VL (for example, −15 volt) is supplied as the data potential to the pixel electrode 21 of the pixel 20 corresponding to a region Rbw where the gradation to be displayed is changed from black to white. The reference potential GND (for example, 0 volt) is supplied as the data potential to the pixel electrode 21 of the pixel 20 corresponding to each of a region Rww where the gradation to be displayed is not changed from white and a region Rbb where the gradation to be displayed is not changed from white. The region Rwb is an example of "a first region" described in the appended claims, the region Rbw is an example of "a second region" described in the appended claims, the region Rww is an example of "a third region" described in the appended claims, and the region Rbb is an example of "a fourth region" described in the appended claims. If this data potential supply is performed in the first frame period T1, for example, an image M1 (see FIG. 15) is displayed in the display section 3. That is, after the this data potential supply is performed in the first frame period T1, a color, such as light grey, somewhat approaching black from white is displayed in the pixel 20 corresponding to the region Rwb from among the pixels 20 which have displayed white, and a color, such as dark grey, somewhat approaching white from black is displayed in the pixel 20 corresponding to the region Rbw from among the pixels 20 which have displayed black. White is continuously displayed in the pixel 20 corresponding to the region Rww from among the pixels 20 which have displayed white, and black is continuously displayed in the pixel 20 corresponding to the region Rbb from among the pixels 20 which have displayed black.

Next, in each of the second frame period T2 subsequent to the first frame period T1 and the third frame period T3 subsequent to the second frame period T2, the same data potential supply as in the first frame period T1 is performed. That is, in each of the second frame period T2 and the third frame period T3, the high potential VH (for example, +15 volt) is supplied to the pixel electrode 21 of the pixel 20 corresponding to the region Rwb as the data potential, the low potential VL (for example, −15 volt) is supplied as the pixel electrode 21 of the pixel 20 corresponding to the region Rbw as the data potential, and the reference potential GND (for example, 0 volt) is supplied as the data potential to the pixel electrode 21 of the pixel 20 corresponding to each of the region Rww where white is maintained and the region Rbb where black is maintained. If this data potential supply is performed in the second frame period T2, for example, an image M2 (see FIG. 15) is displayed in the display section 3. If this data potential supply is performed in the third frame period T3, for example, an image M3 (see FIG. 15) is displayed in the display section 3. The control operation in each of the first frame period T1, the second frame period T2, and the third frame period T3 corresponds to the control operation A.

Next, referring to FIGS. 15 and 17, in the fourth frame period T4 subsequent to the third frame period T3, the data potential supply is performed as follows.

That is, in the fourth frame period T4, the high potential VH (for example, +15 volt) is supplied to the pixel electrode 21 of the pixel 20 corresponding to the region Rwb as the data potential. The low potential VL (for example, −15 volt) is supplied to the pixel electrode 21 of the pixel 20 corresponding to the region Rbw as the data potential. The reference potential GND (for example, 0 volt) is supplied to the pixel electrode 21 of the pixel 20 corresponding to the region Rbb as the data potential. The low potential VL is supplied as the data potential to the pixel electrode 21 of the pixel 20 corresponding to a region Rs which is adjacent to the region Rwb and surrounds at least a part of the region Rwb at a predetermined width (for example, a width corresponding to the size of one pixel) in the region Rww. The reference potential GND (for example, 0 volt) is supplied to the pixel electrode 21 of the pixel 20 corresponding to a region Rwwa excluding the region Rs in the region Rww. The region Rs is an example of "a fifth region" described in the appended claims. The term "partially surrounding region Rs" indicates a region excluding at least the region Rbb in a region adjacent to the region Rwb. When this happens, the low potential VL is supplied to the pixel electrode 21 of the region Rbb where black should be displayed, thereby avoiding the region Rbb from being rewritten in the white direction. The term "partially surrounding region Rs" may be a region excluding the region Rbb and a region where it is known that no edge residual image is generated (for example, a pixel obliquely adjacent to the region Rwb) in a region adjacent to the region Rwb.

Accordingly, in the fourth frame period T4, a voltage based on the potential difference between the low potential VL (for example, −15 volt) and the reference potential GND (for example, 0 volt) is applied between the pixel electrode 21 and the counter electrode 22 of the pixel 20 corresponding to the region Rs which is adjacent to the region Rwb and partially surrounds the region Rwb at a predetermined width. In the fourth frame period T4, a control operation relating to the region Rs corresponds to the control operation B.

Accordingly, it is possible to reliably display white in the pixel 20 corresponding to the region Rs which is adjacent to the region Rwb where the gradation to be displayed is changed from white to black and partially surrounds the region Rwb in the region Rww where the gradation to be displayed is not changed from white. Therefore, it is possible to suppress the occurrence of blurring of the boundary between the white image displayed with white and the black image displayed with black in the image displayed in the display section 3. As a result, it is also possible to suppress the occurrence of the edge residual image.

As shown in FIG. 15, for example, after the above-described data potential supply is performed in the third frame period T3, a blurred portion 910 in which a color, such as grey, approaching black from white is displayed near the boundary between the region Rww and the region Rbw may be generated in an image M3 displayed in the display section 3. The reason for the occurrence of the blurred portion 910 is the same as described with reference to FIG. 5 in the first embodiment. Meanwhile, in the description of FIG. 5, it is assumed that "the pixel 20*a*" is replaced with "a pixel 21*wb*", "the pixel electrode 21*a*" is replaced with "a pixel electrode 21*wb*", "the pixel 21*b*" is replaced with "a pixel 21*ww*", and "the pixel electrode 21*b*" is replaced with "a pixel electrode 21*ww*".

In this embodiment, in particular, as described above, in the fourth frame period T4, the low potential VL is supplied as the data potential to the pixel electrode 21 of the pixel 20 corresponding to the region Rs which is adjacent to the region Rwb where the gradation to be displayed is changed from white to black and partially surrounds the region Rwb at a predetermined width in the region Rww where the gradation to be displayed is not changed from white. For this reason, it is possible to reliably display white in the pixel 20 of the region Rs. Therefore, it is possible to suppress the occurrence of blurring of the boundary of the image displayed in the display section 3.

In this embodiment, in particular, in the fourth frame period T4, the high potential VH (for example, +15 volt) is supplied to the pixel electrode 21 of the pixel 20 corresponding to the region Rwb as the data potential, and the low potential VL (for example, −15 volt) is supplied to the pixel electrode 21 of the pixel 20 corresponding to the region Rbw as the data potential. Accordingly, it is possible to reliably change the gradation of the pixel 20 corresponding to the region Rwb, in which the gradation should be changed from white to black, to black, and to reliably change the gradation of the pixel 20 corresponding to the region Rbw, which is the pixel 20 where the gradation should be changed from black to white, to white. Therefore, it is possible to display the image P2 in the display section 3 as a clear image. In regard to each pixel 20, it is also possible to suppress or prevent collapse of the DC balance ratio (that is, the ratio of the time for which a voltage (that is, the potential difference between the low potential VL and the reference potential GND) based on white is applied between the pixel electrode 21 and the counter electrode 22 and the time for which a voltage (that is, the potential difference between the high potential VH and the reference potential GND) based on black is applied between the pixel electrode 21 and the counter electrode 22). That is, in regard to each pixel 20, it is possible to reduce the difference between the time for which a voltage based on white is applied between the pixel electrode 21 and the counter electrode 22 and the time for which a voltage based on black is applied.

In this embodiment, in particular, the data potential supply (hereinafter, referred to as "boundary region data potential supply") in which the low potential VL is supplied to the pixel electrode 21 of the pixel 20 corresponding to the region Rs as the data potential is performed in the fourth frame period T4 which is the last frame period from among the four continuous frame periods T1, . . . , and T4 when the image displayed in the display section 3 is rewritten. Therefore, it is possible to more reliably suppress the occurrence of blurring of the boundary of the image displayed in the display section 3.

Although in this embodiment, an example has been described where the above-described boundary region data potential supply is performed only in the fourth frame period T4 which is the last frame period from among the four continuous frame periods T1, . . . , and T4, the boundary region data potential supply may be performed in at least one of the first frame period T1, the second frame period T2, and the third frame period T3, in addition to the fourth frame period T4. That is, the above-described data potential supply in the fourth frame period T4 may be performed in one of the first frame period T1, the second frame period T2, and the third frame period T3, in addition to the fourth frame period T4. It is preferable that the above-described boundary region data potential supply is performed in at least one of the second-half frame periods (that is, the third frame period T3 and the fourth frame period T4) of the four frame periods T1, . . . , and T4. In this case, it is possible to more reliably the occurrence of blurring of the boundary of the image displayed in the display section 3.

Electronic Apparatus

Next, an electronic apparatus to which the above-described electrophoretic display is applied will be described with reference to FIGS. 18 and 19. The following description will be provided as to an example where the above-described electrophoretic display is applied to an electronic paper and an electronic notebook.

Figure 18:
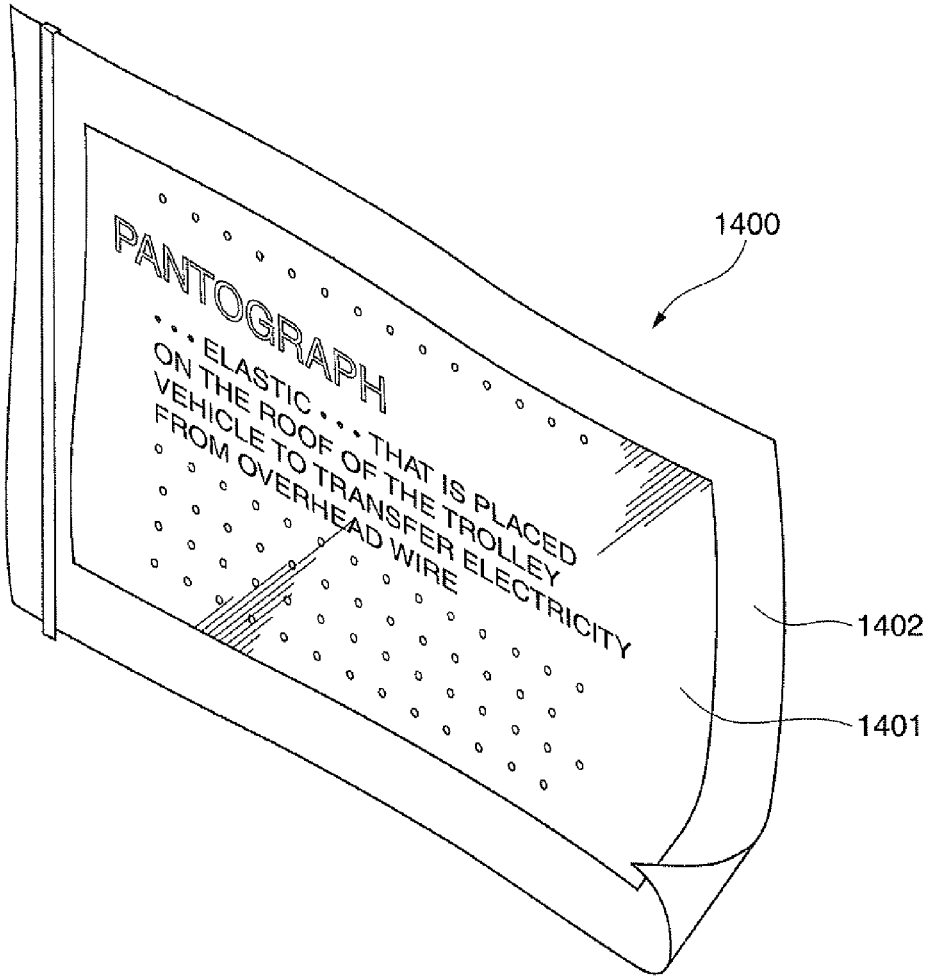
FIG. 18 is a perspective view showing the configuration of an electronic paper which is an example of an electronic apparatus, to which an electro-optical device is applied.

FIG. 18 is a perspective view showing the configuration of an electronic paper 1400.

As shown in FIG. 18, the electronic paper 1400 includes the electrophoretic display of the foregoing embodiment as a display section 1401. The electronic paper 1400 is flexible, and includes a main body 1402 which is formed of a rewritable sheet having the same texture and plasticity as paper.

Figure 19:
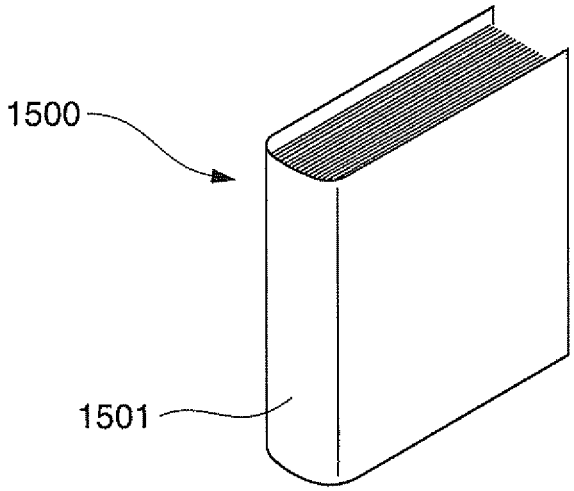
FIG. 19 is a perspective view showing the configuration of an electronic notebook which is an example of an electronic apparatus, to which an electro-optical device is applied.

FIG. 19 is a perspective view showing the configuration of an electronic notebook 1500.

As shown in FIG. 19, the electronic notebook 1500 is configured such that a plurality of electronic papers 1400 shown in FIG. 18 are bundled and held by a cover 1501. The cover 1501 includes a display data input unit (not shown) which inputs, for example, display data sent from an external apparatus. This allows changing or updating the display content in accordance with display data in a state where the electronic papers are bundled.

The electronic paper 1400 and the electronic notebook 1500 include the electrophoretic display of the foregoing embodiment, thereby performing high-quality image display.

The electrophoretic display of the foregoing embodiment may be applied to a display section of an electronic apparatus, such as a wristwatch, a mobile phone, or a portable audio instrument.

Although in the foregoing embodiments and modifications, an example where the white particles 82 are negatively charged and the black particles 83 are positively charged has been described, the white particles 82 may be positively charged and the black particles 83 may be negatively charged. The electrophoretic element 23 is not limited to the configuration in which the microcapsules 80 are provided, and may have a configuration in which an electrophoretic dispersion medium and electrophoretic particles are provided in a space partitioned by a partition wall. Although an example where the electro-optical device has the electrophoretic element 23 has been described, the invention is not limited thereto. Any electro-optical device may be used insofar as the electro-optical device includes a display element in which an edge residual image is generated, as in the foregoing embodiments. For example, an electro-optical device using an electrogranular fluid may be used.

The invention is not limited to the foregoing embodiments, and may be appropriately changed without departing from the subject matter or spirit of the invention described in the appended claims and the specification. A method of controlling an electro-optical device, a control device for an electro-optical device, an electro-optical device, and an electronic apparatus accompanied by the changes still fall within the technical scope of the invention.

The entire disclosure of Japanese Patent Application Nos: 2011-090914, filed Apr. 15, 2011 and 2011-182706, filed Aug. 24, 2011, and U.S. Provisional Application No. 61/484,410 are expressly incorporated by reference herein.

What is claimed is:

1. A method of controlling an electro-optical device, wherein the electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section, the method comprises:

during image rewriting to rewrite an image displayed in the display section, executing control operation A to control the driving section such that, in the frame periods, a second gradation potential based on a second gradation is supplied as the data potential to the pixel electrode of each pixel corresponding to a first region which is a region where a gradation to be displayed in the display section is changed from a first gradation to the second gradation different from the first gradation, a first gradation potential based on the first gradation is supplied as the data potential to the pixel electrode of each pixel corresponding to a second region of the display section which is a region where the gradation to be displayed in the display section is changed from the second gradation to the first gradation, and the same potential as the potential on the counter electrode is supplied to the pixel electrode of each pixel corresponding to each of a third region which is a region where the gradation to be displayed in the display section is not changed from the first gradation and a fourth region which is a region where the gradation to be displayed in the display section is not changed from the second gradation; and during image rewriting, executing a control operation B to control the driving section such that, in the frame periods, the first gradation potential is supplied as the data potential to the pixel electrode of each pixel corresponding to a fifth region, which is a region adjacent to the first region to surround at least a part of the first region at a predetermined width in the third region of the display section, the first gradation potential being supplied to the pixel electrode of each pixel corresponding to the fifth region simultaneously with supplying, in the control operation B, supplying the second gradation potential to the pixel electrode of each pixel corresponding to the first region, supplying the first gradation potential to the pixel electrode of each pixel corresponding to the second region, and supplying the same potential as the potential on the counter electrode to the pixel electrode of each pixel corresponding to each of the third region and the fourth region, and an end of a time period during which the first gradation potential is supplied as the data potential to the pixel electrode of each pixel corresponding to a fifth region does not extend beyond an end of a time period during which the second gradation potential is supplied to the pixel electrode of each pixel corresponding to the first region, the first gradation potential is supplied to the pixel electrode of each pixel corresponding to the second region, and the same potential as the potential on the counter electrode is supplied to the pixel electrode of each pixel corresponding to each of the third region and the fourth region.

2. The method according to claim 1, wherein the control operation B is executed as at least single potential supply of the second-half potential supply of the multiple times of potential supply.

3. The method according to claim 1, wherein, during the control operation B, the driving section is controlled such that the second gradation potential is supplied to the pixel electrode of each pixel corresponding to the first region as the data potential, and the first gradation potential is supplied to the pixel electrode of each pixel corresponding to the second region as the data potential.

4. A control device for an electro-optical device, wherein the electro-optical device includes a display section which has a plurality of pixels at intersections of a plurality of scanning lines and a plurality of data lines with an electro-optical material between a pixel electrode and a counter electrode arranged to be opposite each other, and a driving section which executes potential supply multiple times to supply a data potential based on image data to the pixel electrode of each of the plurality of pixels in a predetermined frame period so as to display an image based on image data in the display section, the control device comprises:

a first control unit which, during image rewriting to rewrite an image displayed in the display section, controls the driving section such that, in the frame periods, a second gradation potential based on a second gradation is supplied as the data potential to the pixel electrode of each pixel corresponding to a first region which is a region where a gradation to be displayed in the display section is changed from a first gradation to the second gradation different from the first gradation, a first gradation potential based on the first gradation is supplied as the data potential to the pixel electrode of each pixel corresponding to a second region of the display section which is a region where the gradation to be displayed in the display section is changed from the second gradation to the first gradation, and the same potential as the potential on the counter electrode is supplied to the pixel electrode of each pixel corresponding to each of a third region which is a region where the gradation to be displayed in the display section is not changed from the first gradation and a fourth region which is a region where the gradation to be displayed in the display section is not changed from the second gradation; and a second control unit which, during image rewriting, controls the driving section such that, in the frame periods, the first gradation potential is supplied as the data potential to the pixel electrode of each pixel corresponding to a fifth region which is a region adjacent to the first region to surround at least a part of the first region at a predetermined width in the third region of the display section, the first gradation potential being supplied to the pixel electrode of each pixel corresponding to the fifth region simultaneously with supplying the second gradation potential to the pixel electrode of each pixel corresponding to the first region, supplying the first gradation potential to the pixel electrode of each pixel corresponding to the second region, and supplying the same potential as the potential on the counter electrode to the pixel electrode of each pixel corresponding to each of the third region and the fourth region, and an end of a time period during which the first gradation potential is supplied as the data potential to the pixel electrode of each pixel corresponding to a fifth region does not extend beyond an end of a time period during which the second gradation potential is supplied to the pixel electrode of each pixel corresponding to the first region, the first gradation potential is supplied to the pixel electrode of each pixel corresponding to the second region, and the same potential as the potential on the counter electrode is supplied to the pixel electrode of each pixel corresponding to each of the third region and the fourth region.

5. An electro-optical device comprising:

the control device for an electro-optical device according to claim 4.

6. An electronic apparatus comprising:

the electro-optical device according to claim 5.

* * * * *